US006293133B1

(12) United States Patent
Svejkovsky et al.

(10) Patent No.: US 6,293,133 B1
(45) Date of Patent: Sep. 25, 2001

(54) METHOD OF ROLLING FINISHED SECTIONS FROM PRELIMINARY SECTIONS IN REVERSING ROLL STAND ARRANGEMENTS

(75) Inventors: Ulrich Svejkovsky, Wuppertal; Hans-Jürgen Nowak, Kamp-Lintfort; Georg Engel, Düsseldorf, all of (DE); David A. Fournie; Lloyd M. Schmelzle, both of Desoto, TX (US)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/460,335

(22) Filed: Dec. 10, 1999

(51) Int. Cl.[7] ..... B21B 13/10; B21B 41/06
(52) U.S. Cl. ..... 72/225; 72/229
(58) Field of Search ..... 72/229, 225, 226, 72/202, 201, 200, 228

(56) References Cited

U.S. PATENT DOCUMENTS 5,121,622 * 6/1992 Kosak et al. ..... 72/229
5,904,061 * 5/1999 Engel et al. ..... 72/229

* cited by examiner

*Primary Examiner*—Rodney A. Butler
(74) *Attorney, Agent, or Firm*—Friedrich Kueffner

(57) ABSTRACT

A method of rolling finished sections from preliminary sections by means of roll stand arrangements which operate in reversing operation and include a compact rolling group composed of a first universal stand at the entry side and a second universal stand at the exit side and an intermediate edging stand arranged between the universal stands, and a roughing group arranged in front of the compact rolling group and composed of vertical roll stands and horizontal roll stands and/or universal stands. A rectangular preliminary section or a preliminary section having the approximate final dimensions is preshaped in the roll stands of the roughing rolling group in a number of shape changing passes and/or shape reduction passes, possibly reversing with or without the use of selectable grooves. Subsequently, the section is further shaped in the compact rolling group in several shape changing passes or shape reduction passes in the universal stand on the entry side. Subsequently, the section is shaped into the finished section in the universal stand on the exit side or in the intermediate edging stand, possibly also with the use of the selectable grooves or the grooves of the roll stands located next to each other.

9 Claims, 31 Drawing Sheets

METHOD OF ROLLING FINISHED SECTIONS FROM PRELIMINARY SECTIONS IN REVERSING ROLL STAND ARRANGEMENTS

BACKGROUND OF THE INVENTION

1. Field of the Invention

The present invention relates to a method of rolling finished sections from preliminary sections by means of roll stand arrangements which operate in reversing operation. The roll stand arrangements include a compact rolling group composed of a first universal stand at the entry side and a second universal stand at the exit side and an intermediate edging stand arranged between the universal stands, and a roughing group arranged in front of the compact rolling group and composed of vertical roll stands and horizontal roll stands and/or universal stands.

2. Description of the Related Art

The rolling of sheet piling sections and angle sections and similar sections has in the past generally been carried out in fully continuously operating rolling trains, wherein the large number of shaping grooves necessary in reversing operation for the roughing rolling of such sections required great lengths of the bodies of the rolls for accommodating the number of shaping grooves. These large stands and the rolls themselves, as well as the necessary manipulating devices for introducing the rolling stock into the various grooves are very complicated, require a large amount of space and have relatively low throughput capacities. The large quantities of rolling stock lead to relatively long rolling times during reversing rolling and, therefore, they do not make it possible to operate such plants in a timed sequence with a continuous casting machine. For this reason, relatively large intermediate storage facilities are required when continuous casting plant and rolling mill are used together.

Moreover, in the case of fully continuous rolling particularly of angle steel sections and U-shaped steel sections, six or more roll stands with the appropriate drives are required because of the large number of shaping grooves.

In addition to the disadvantages described above, this leads to high costs for the large number of rolls to be made available and for exchanging and refinishing the rolls. Furthermore, in the case of discontinuous roughing rolling and the also continuous finish rolling, different temperatures over the length of the rolling stock cannot be avoided, wherein the different temperatures occur as so-called temperature wedges between the beginning and the end of the rolling length caused by the relatively low entry speed of the rolling stock into the first stand of the rolling train. These temperature wedges must be compensated or controlled in order to meet the requirements made of the rolling stock, for example, by heat treating plants. It has already been demanded to combine the production of a relatively small number of sheet piles and different angle sections with the production of girders or beams in the plants of the above-described type in which practically only girders were rolled in the past. However, since the production of girders or beams always takes place in a combined operation with a continuous casting plant, i.e., without reversing roughing stands, the combinations with a production of sheet piles and angle sections could only be realized with an extremely large number of additional devices and reassemblies.

SUMMARY OF THE INVENTION

Therefore, it is the primary object of the present invention to carry out rolling of sheet piling sections and angle sections, as well as other comparable sections, by means of roll stand arrangements having the basic configuration described above, wherein as initial products either continuously cast rectangular blooms are used or preliminary sections are used which are already cast in a preliminary shape which approximates as much as possible the final product. The number of shaping grooves required for all rolling steps should be reduced as much as possible in order to achieve an economical shaping with production times which permit a combined operation of continuous casting machine and rolling mill.

In accordance with the present invention, with one or more of the roll stands of the roughing rolling group and/or one or more of the roll stands of the compact rolling group being equipped with several selectable grooves which can optionally be moved into and out of the rolling line, or with grooves of a roll stand being located next to each other which can become effective for rolling by displacing the rolling stock transversely of the rolling line, a rectangular preliminary section or a preliminary section having the approximate final dimensions is preshaped in the roll stands of the roughing rolling group in a number of shape changing passes and/or shape reduction passes, possibly reversing with or without the use of the selectable grooves. Subsequently, the section is further shaped in the compact rolling group, possibly in a reversing manner, in several shape changing passes or shape reduction passes in the universal stand on the entry side, possibly in the intermediate edging stand with or without the use of the selectable grooves or the grooves of the roll stands located next to each other. Subsequently, the section is shaped into the finished section in the universal stand on the exit side or in the intermediate edging stand, possibly also with the use of the selectable grooves or the grooves of the roll stands located next to each other.

In the method according to the present invention, the roughing rolling group can also operate continuously with or without free runout of the rolling stock between the two roll stand groups or also in a rolling line transversely offset parallel to the rolling line of the compact rolling group.

The roughing rolling group may be composed of one roll stand or of several roll stands. It is possible to use horizontal roll stands, vertical roll stands or universal roll stands as well as other combinations of the types of roll stands. When using universal roll stands, these can also be constructed as combination stands which optionally operate as two-high stands.

When carrying out the method according to the present invention with a roughing rolling group having a universal stand and/or a vertical two-high stand and a horizontal two-high stand and a compact rolling group whose intermediate edging stand includes two or more rolling grooves, the preliminary section reduced by edging in the roughing rolling group can be finish-shaped in a section-reducing manner in a reversing pass in the universal stand on the entry side following a section-changing shaping in the universal stand on the entry side and in the selectable passes of the intermediate edging stand.

However, in accordance with another possibility, using a roughing rolling group including a vertical two-high stand or a universal stand and a horizontal two-high stand and a compact rolling group whose intermediate edging stand includes two or more selectable grooves, the preliminary section is edged in the roughing rolling group, and the preliminary section is shaped in a profile-changing manner in one pass or several reversing passes in the horizontal two-high stand of the roughing rolling group having profiled rolls. In subsequent reversing passes between the universal stand on the entry side and the selectable grooves of the intermediate edging stand, the section is shaped in an essentially section-reducing manner in the universal stand and is shaped in section-changing manner in the selectable grooves and is finish-shaped in an also section-changing manner in the universal stand on the exit side.

When using a roughing rolling group with a vertical two-high stand or a universal stand and a horizontal two-high stand and a compact rolling group with a roll stand each on the entry side and on the exit side each having two two-high roll sets with two or more grooves and with corresponding transverse shifting devices for the rolling stock and an intermediate edging stand with or without selectable grooves arranged between the roll stands, it is possible in accordance with the present invention to proceed in such a way that the preshaped preliminary section or the preliminary section subjected to edging in the vertical two-high stand or in the universal stand of the roughing rolling group is shaped in a section-changing manner in one pass or several passes in the horizontal two-high stand or in a reversing operation in the selectable grooves of a horizontal two-high stand, and that the section is subsequently finish-shaped alternatingly reversing in the two adjacent grooves of the two roll stands of the compact rolling group of the entry side and the exit side, possibly with the utilization of the intermediate edging stand.

When using a roughing rolling group with a vertical two-high stand or a universal stand and a horizontal two-high stand and a compact rolling group composed of a tandem stand each on the entry side and the exit side each having two-high roll pairs with two or more grooves and corresponding transverse shifting devices for the rolling stock and an intermediate edging stand with or without selectable grooves arranged between the two tandem stands, the method can be carried out in such a way that the preshaped preliminary section or the preliminary section having the rectangular cross-section is shaped in a section-changing manner in the universal stand possibly equipped with profiled horizontal rolls and in the horizontal two-high stand of the roughing rolling group also possibly equipped with profiled horizontal rolls in several reversing passes between the two roll stands, and the section is subsequently finish-shaped in a reversing operation in the grooves of the two tandem stands with or without the inclusion of a pass in the intermediate edging stand having profiled rolls.

However, the methods and roll stand arrangements described above only make it possible to achieve relatively small productions. In addition, the guidance of the section already shaped by rolling in the tandem stands sometimes poses technical difficulties. It is essentially only possible to produce sheet piling sections having U-shaped cross-sections, but not those with Z-shaped cross-sections for which there is a great demand today in various markets.

In accordance with the present invention, the above-described disadvantages are eliminated and rolling of sheet piling sections with U-shaped cross-section as well as those with Z-shaped cross-section in all sizes and with a good output of the roll stand arrangement is made possible by providing the roughing rolling group in a first rolling line with a runout roller table and, following the runout table, arranging a transverse conveying unit and a parallel run-in roller table for the compact tandem stand group in a second rolling line, wherein the horizontal stand of the roughing rolling group and/or the intermediate edging stand of the compact tandem stand group each have two selectable grooves, and wherein one or more two-high horizontal stands with grooved rolls are arranged following the universal stand of the compact tandem stand group on the exit side. When rolling is carried out in this stand arrangement, the width adjustment and a shape adjustment of a preliminary section having a H-shaped cross-section takes place with simultaneous reduction of the cross-section in the roughing rolling group and the further reduction of the cross-section with preshaping of the section ends for forming the interlocks takes place in the compact tandem stand group and the final finish-shaping of the interlocks of the section takes place in the grooves of the two-high roll stands.

The above-described method utilizing a roughing rolling group with a vertical two-stand and a horizontal two-high stand and a roughing group whose intermediate edging stand has two selectable grooves, in which the preliminary section reduced by edging in the roughing rolling group is finish-shaped in a section reducing manner in a reversing pass in the universal stand on the exit side following the section-changing shaping in the universal stand on the entry side in the selectable grooves of the intermediate edging stand, is also suitable for rolling lift mast sections from continuously cast preliminary sections having an I-shaped cross-section, wherein the method is carried out in such a way that, with the horizontal stands of the roughing rolling group and the intermediate edging stand of the compact rolling group being equipped with selectable grooves, the preliminary section is edged in the vertical stand of the roughing rolling group, the section is subsequently shaped and reduced in the selectable grooves of the horizontal stand of this roughing rolling group and the section is subsequently further reduced in the universal stand of the compact rolling group on the entry side and the selectable grooves of the intermediate edging stand and is finally shaped in the universal stand on the exit side.

Suitable for rolling crawler chain links is the already described method in which a vertical two-high stand and a horizontal two-high stand are used in the roughing rolling group and the compact rolling group is composed of a tandem stand on the entry side and a tandem stand on the exit side each having two-high roll pairs with two or more grooves and with corresponding transverse shifting devices for the rolling stock and an intermediate edging stand with or without selectable grooves arranged between the two tandem stands, wherein the method is carried in such a way that the preliminary section having a preshaped cross-section or a rectangular cross-section is shaped in a section-changing manner in the horizontal two-high stand of the roughing group provided with profiled horizontal rolls and is subsequently finish-shaped in a reversing operation in the grooves of the two tandem stands with or without the inclusion of a pass in the intermediate edging stand provided with profiled rolls. In this method, preliminary sections with rectangular cross-section are those with I-shaped cross-section and possibly a slightly increased thickness web portion are edged in the roughing stand of the roughing rolling group, are subsequently section-preshaped in the horizontal stand of this group and are then finish-rolled in two or three passes and reversing pass sequences with or without inclusion of the selectable grooves of the intermediate edging stand in the compact tandem stand group.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
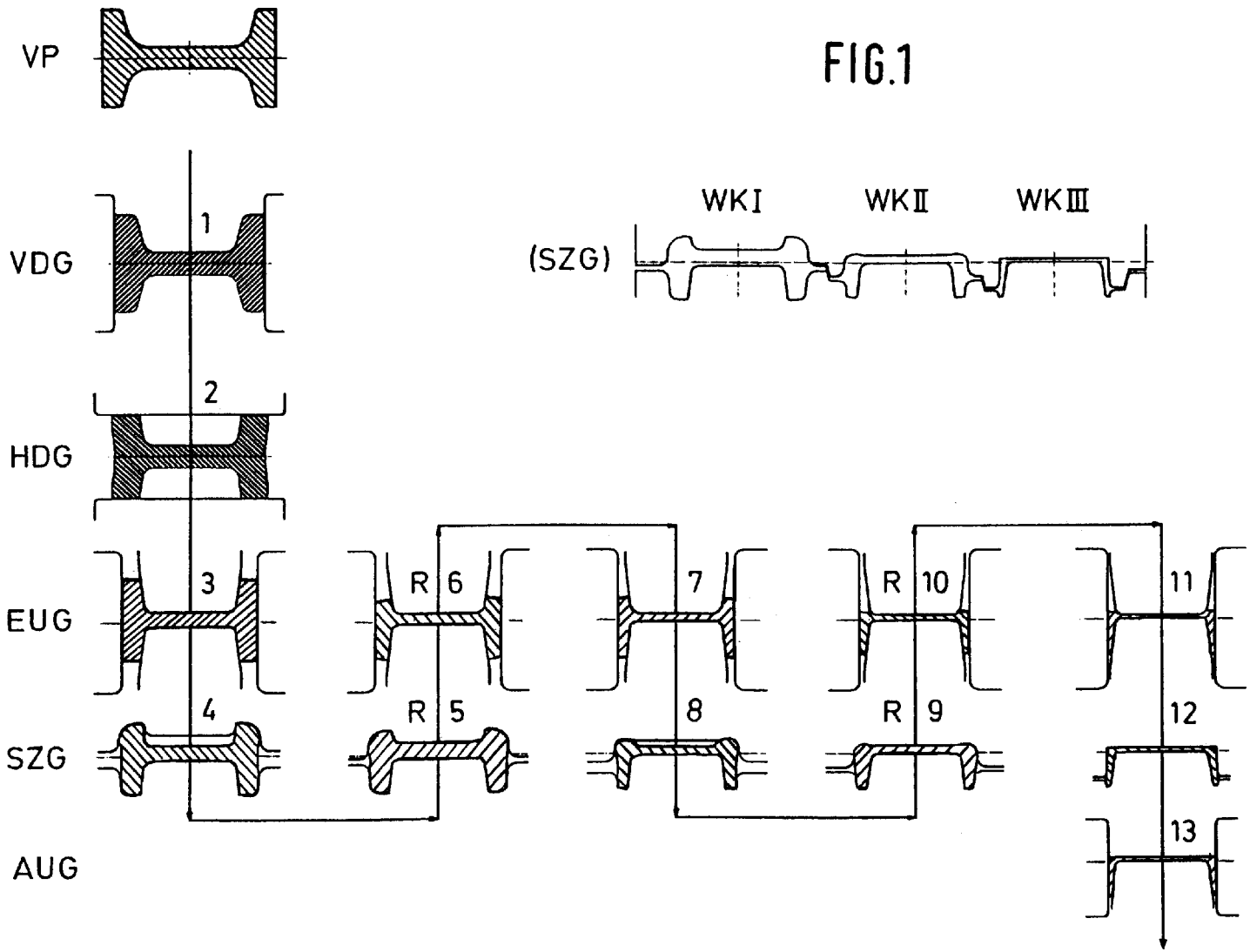
FIGS. 1–6 are pass schedules for roll stand arrangements with vertical two-high stands or universal stands or universal stands and horizontal two-high stands in the roughing rolling group and universal stands on the entry side, intermediate upsetting stands with selectable grooves and universal stands on the exit side in the compact rolling group.

As can be seen in FIG. 1 of the drawing, the preliminary section VP adjusted approximately to the finished section is edged horizontally in a first pass in a vertical two-high stand VDG and is subsequently vertically hedged in a second pass in a horizontal tow-high stand HDG. The section then leaves the roughing group composed of the two stands mentioned above and enters in a third pass the universal stand EUG on the entry side of the compact rolling group. This pass 3 is followed by another pass 4 through the first selectable groove WKI of the intermediate edging stand and another reducing reversing pass 5 in the same selectable groove WKI. The following pass R6 in reversing direction again takes place through the universal stand on the entry side and another pass 7 takes place through this stand, wherein the section thickness is reduced in both cases, and subsequently a pass 8 is carried out through the next selectable groove WKII of the intermediate edging stand SEG. This is followed by a reversing pass R9 through the same selectable groove with a further reduction of the section, followed by a pass R10 in reversing direction again through the universal stand EUG on the entry side and a reversing pass 11 in the same stand. The preliminary section emerging from the stand, which has almost reached its final shape, is then guided and finish-shaped in successive passes 12 and 13 through the third selectable groove WKIII of the intermediate edging stand SZG and the universal stand AUG on the exit side.

Figure 2:
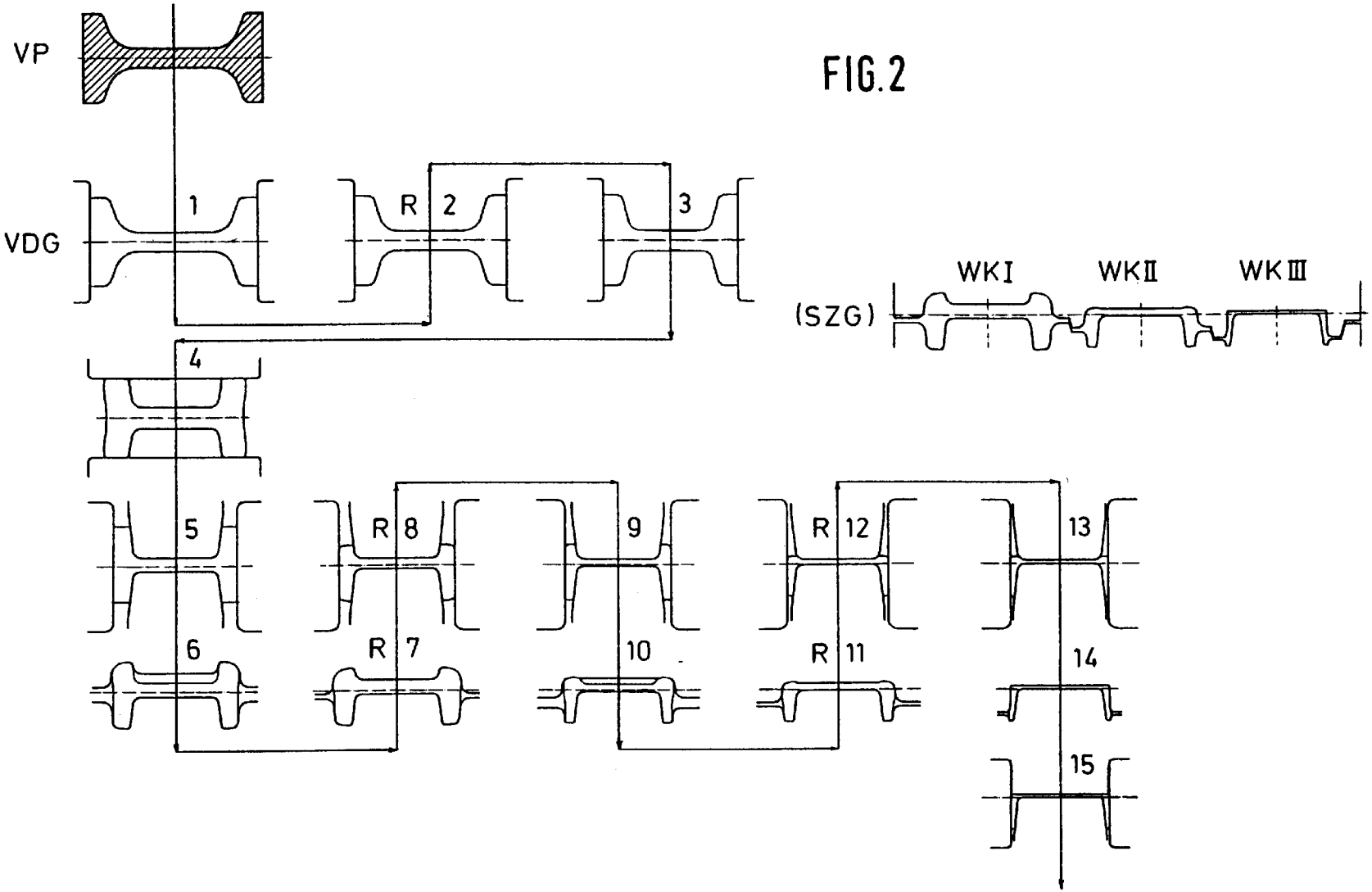
Figure 3:
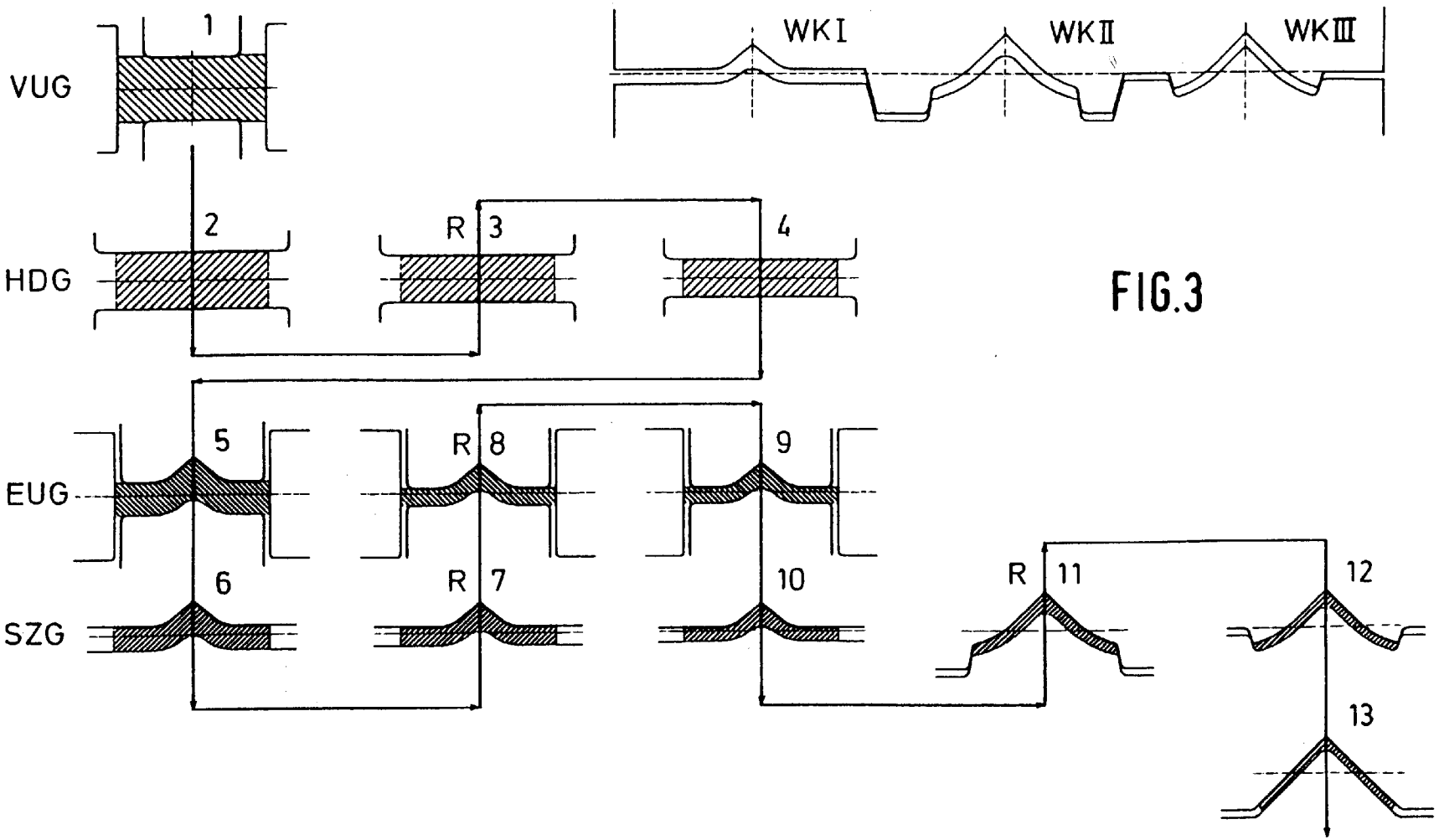

The pass schedule of FIG. 2 differs from the one of FIG. 1 in that the preliminary section VP is horizontally edged in a reversing operation in the vertical two-high stand VDG of the roughing rolling group in three passes 1, R2 and 3; subsequently, as in the embodiment of FIG. 1, the section is vertically edged in the horizontal two-high stand HVG and is then further shaped in the same manner as in the pass schedule of FIG. 1. Similar to the pass schedules described above, in the pass schedule according to FIG. 3, a preliminary section VP having a rectangular cross-section is horizontally edged in one pass in the universal stand UG of the roughing rolling group and is subsequently further edged in three or more successive reversing passes 2, R3 and 4 in the horizontal two-high stand. Subsequently, in the compact rolling group, a section-changing and section-reducing shaping takes place in always two successive passes 5, 6, reversing passes R7 and R8, and passes 9, 10 in the universal stand EUG on the entry side and the first of the two selectable grooves WKI and WKII of the intermediate edging stand SZG, followed by two successive reversing passes R11 and 12 in the third selectable groove WKIII of the intermediate edging stand SZG and a finish-shaping pass 13 in the universal stand AUG on the exit side.

Figure 4:
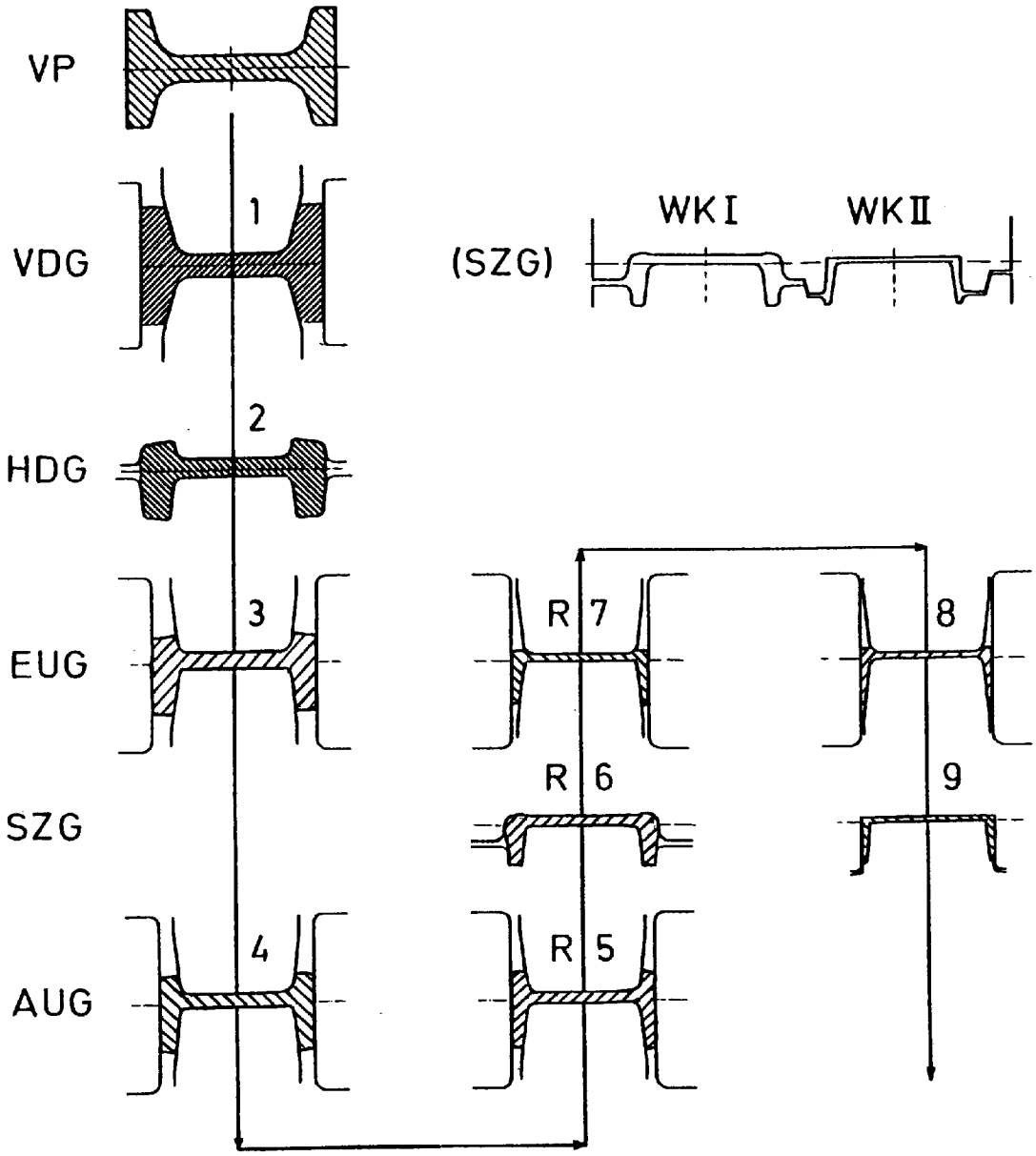

In the pass schedule of FIG. 4, the preliminary section VP is horizontally edged in the vertical two-high stand VDG of the roughing rolling group in a first pass 1 and is then already shaped in a section-changing manner in the horizontal two-high stand HDG in a second pass 2. In two additional subsequent passes 3, 4 in the universal stand on the entry side and the universal stand on the exit side, a reversing pass R5 in the same stand and subsequent passes R6 and R7, the section is shaped in a strongly section-changing manner in the first selectable groove WKI of the intermediate edging stand SZG and then again in the universal stand EUG on the entry side; this is followed by two passes 8 and 9 through the universal stand EUG on the entry side and through the second selectable groove WKII of the intermediate edging stand in order to already finish-shape the section.

Figure 5:
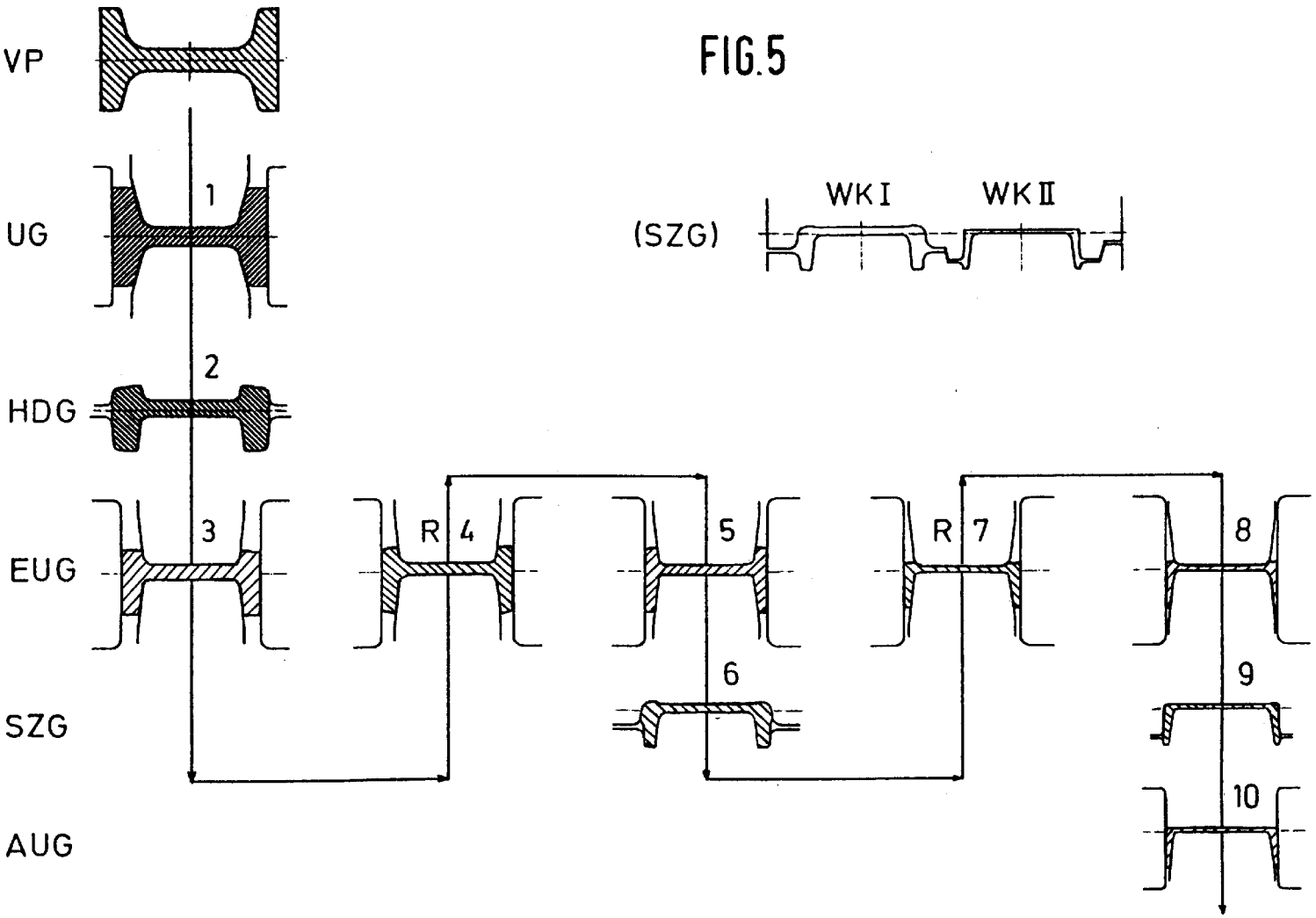

With respect to the first three passes, the pass schedule according to FIG. 5 corresponds to that of FIG. 4. The pass 3 in the universal stand EUG on the entry side is followed by a reversing pass R4 through the same stand and another pass 5 also through this stand; the universal stand AUG on the exit side is not used in this embodiment. The subsequent pass 6 through the first selectable groove WKI of the intermediate edging stand SZG is then followed by another reversing pass R7 again through the universal stand EUG on the entry side and subsequent pass 8 through this stand and two following passes 9 through the second selectable groove WKII of the intermediate edging stand SZG and now through the universal stand AUG on the exit side in order to finish-shape the section.

Figure 6:
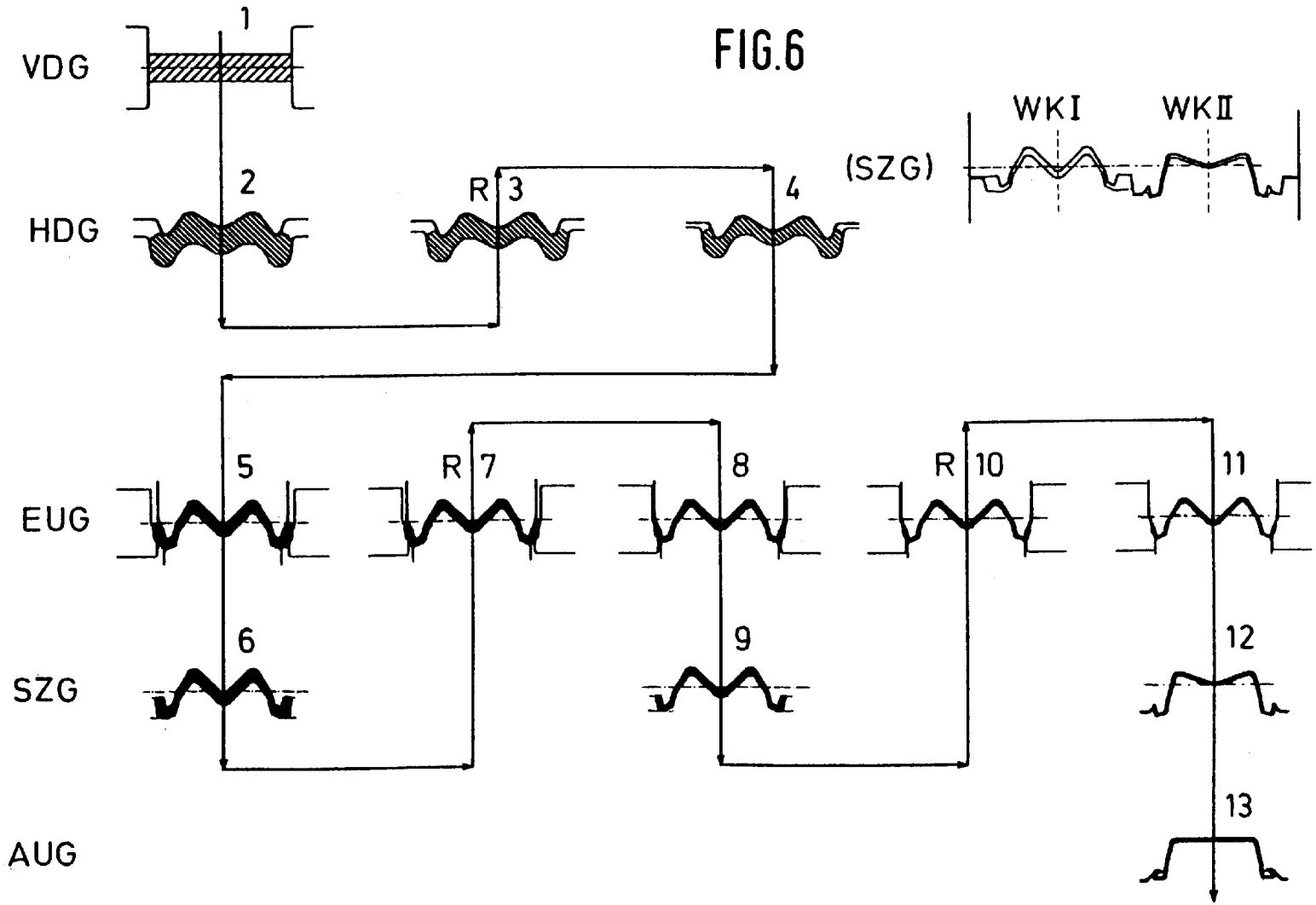

In the pass schedule according to FIG. 6, a preliminary section VP having a rectangular cross-section is edged in one pass in the vertical two-high stand VDG and is shaped in a section-changing and section-reducing manner in three additional reversing passes 2, R3 and 4 using profiled rolls of the horizontal two-high stand HVG. The achieved shape of the section is further changed and reduced in the compact rolling group in two successive passes 5, 6 in the universal stand EUG on the entry side and in the first selectable groove WKI of the intermediate upsetting stand, as well as in the following reversing passes R7, 8 and 9 again through the universal stand EUG on the entry side and the first selectable groove WKI of the intermediate edging stand SZG. Another reversing pass R10 and a subsequent pass 11 are then again carried out through the universal stand EUG on the entry side. These passes are followed in the same direction by a pass 12 through the second selectable groove WK2 of the intermediate edging stand SZG and the finishing pass 13 through the universal stand AUG on the ext side.

Figure 7:
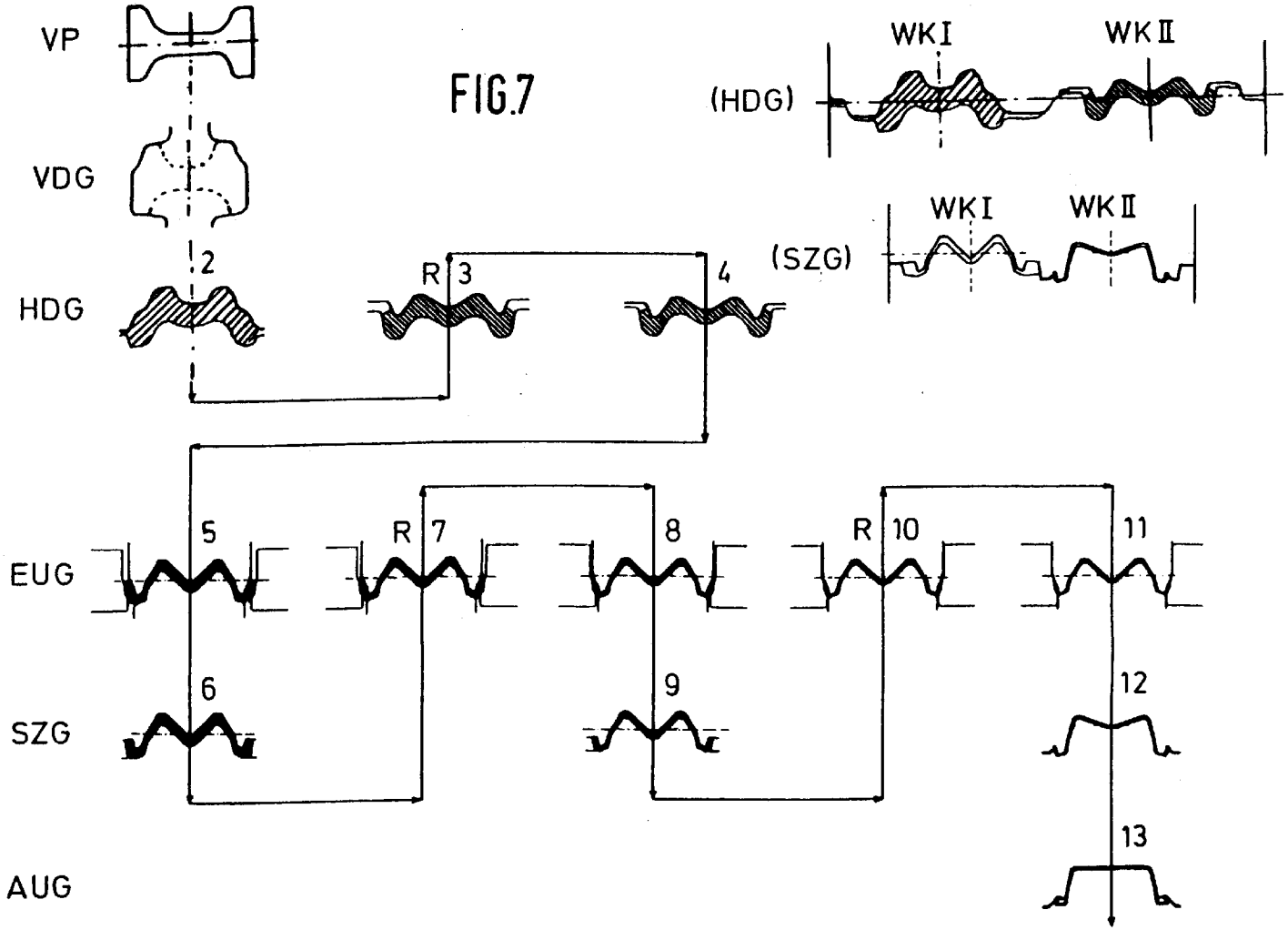
FIGS. 7 and 8 are pass schedules corresponding to the pass schedules and stand arrangements of FIGS. 1–6, wherein the horizontal two-high stands are also equipped with selectable grooves.

The pass schedule according to FIG. 7 differs from that of FIG. 6 essentially only in that the preliminary section VP has a cross-section approximately corresponding to the finished section and is preshaped in a first pass 1 through the vertical two-high stand, followed by reversing passes 2 in the first selectable groove WKI in the horizontal two-high stand, which in this case has two selectable grooves WKI and WKII, and followed by two passes 3 and 4 through the second selectable groove WKII of this horizontal two-high stand HDG. Further shaping is then carried out in the same manner in passes 5 to 13 as in the pass sequence of FIG. 6.

Figure 8:
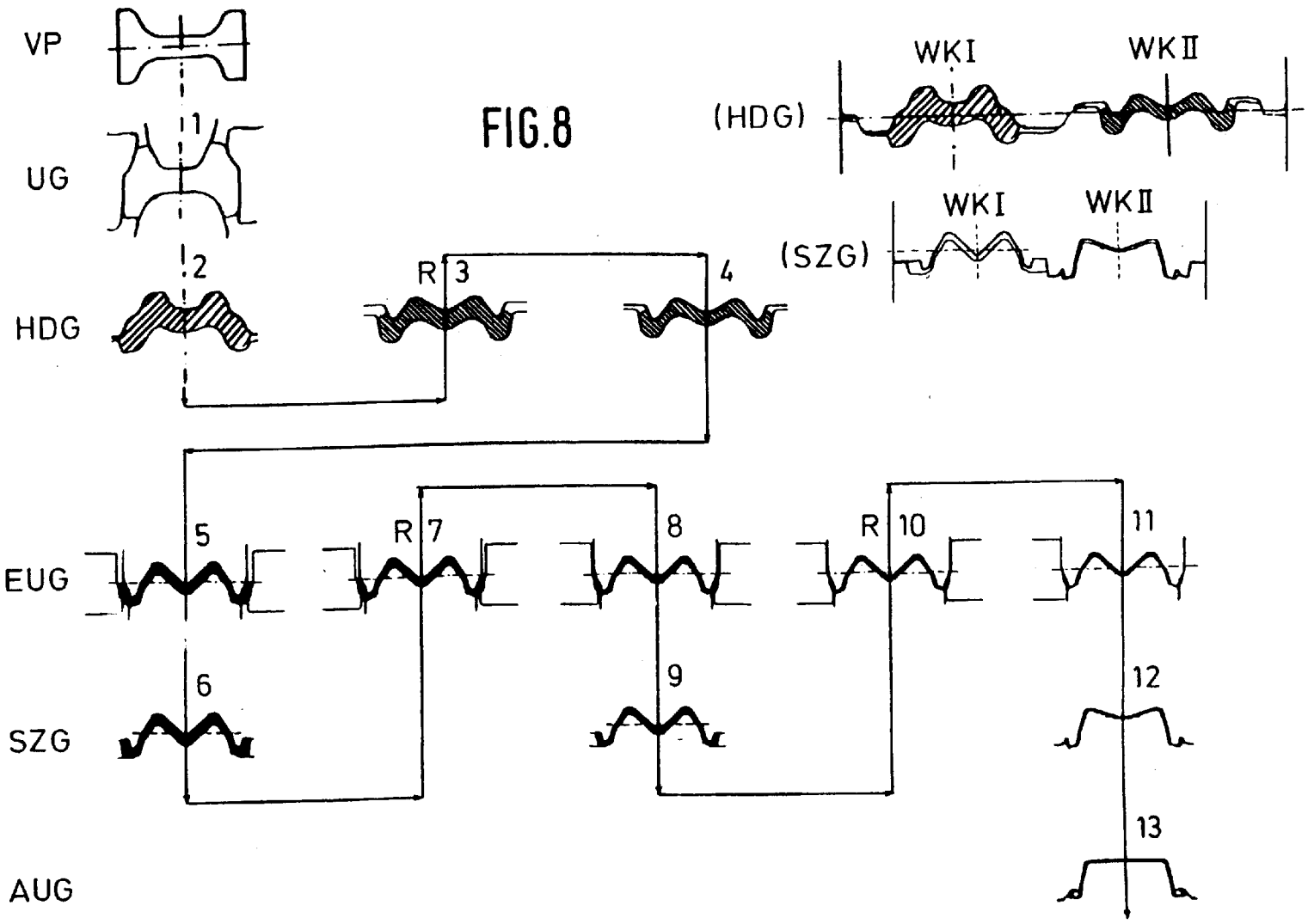

The pass schedule of FIG. 8 corresponds to that of FIG. 7 except that, in this case, the preliminary section VP is preshaped in one pass in a universal stand UG of the roughing rolling group in such a way as it is required for the following second pass in the selectable groove WKI of the horizontal two-high stand HDG. The further passes R3 to 13 correspond to those of FIG. 7.

Figure 9:
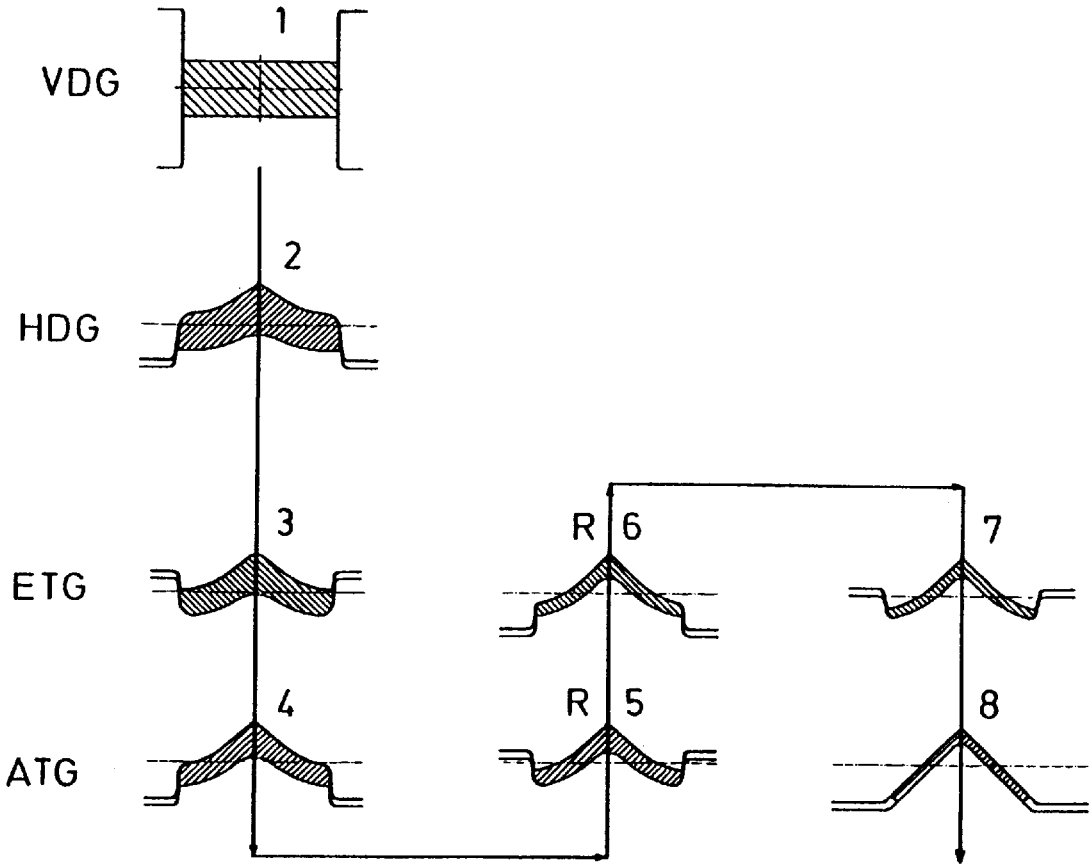
FIGS. 9–15 are pass schedules with or without vertical two-high stands or universal stands and horizontal two-high stand sin the roughing rolling group and tandem stands on the entry side and on the exit side with or without intermediate edging stands of the compact rolling group arranged between the tandem stands.

In the pass schedule according to FIG. 9, a preliminary section having a rectangular cross-section is horizontally edged in one pass 1 in the vertical two-high stand VDG and is then shaped in a section-changing manner in the second pass 2 in the horizontal two-high stand with profiled rolls in such a way that it can be finish-shaped subsequently in the compact rolling group in the tandem stands ETG and ATG in always two successive passes 3, 4 and reversing passes R5, R6 and in the opposite direction in additional passes 7, 8 in the same subsequent grooves.

Figure 10:
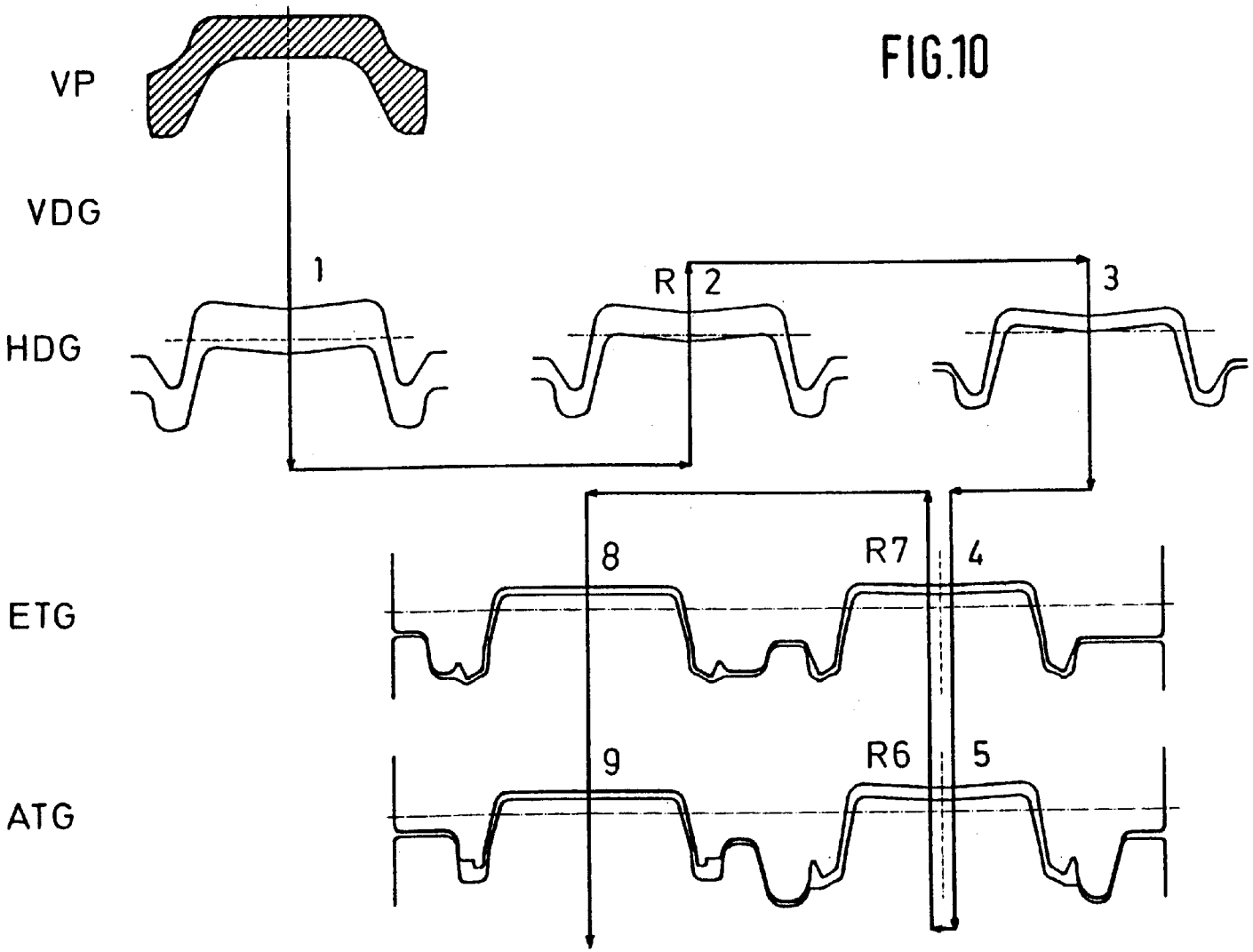

In the pass schedule of FIG. 10, a preliminary section VP, whose cross-section corresponds to the cross-section of the finished section to be rolled and which therefore does not require a preliminary edging in the roughing rolling group, is preshaped in a section-reducing manner in a groove formed by the profiled rolls in three reversing passes 1, R2 and 3 to such an extent that, after additional reducing passes 4, 5 through the tandem stand ETG on the entry side and through the tandem stand ATG on the exit side, the section is rolled in two successive rolling passes R6 and R7 through the same row of grooves, wherein the groove 5 is slightly adjusted in order to achieve a driving effect and to transport the rolled bar through the groove 4. If necessary, the groove 4 has to be slightly opened. Subsequently, the bar is finish-shaped in the passes 8 and 9 through the other row of grooves of both stands.

Figure 11:
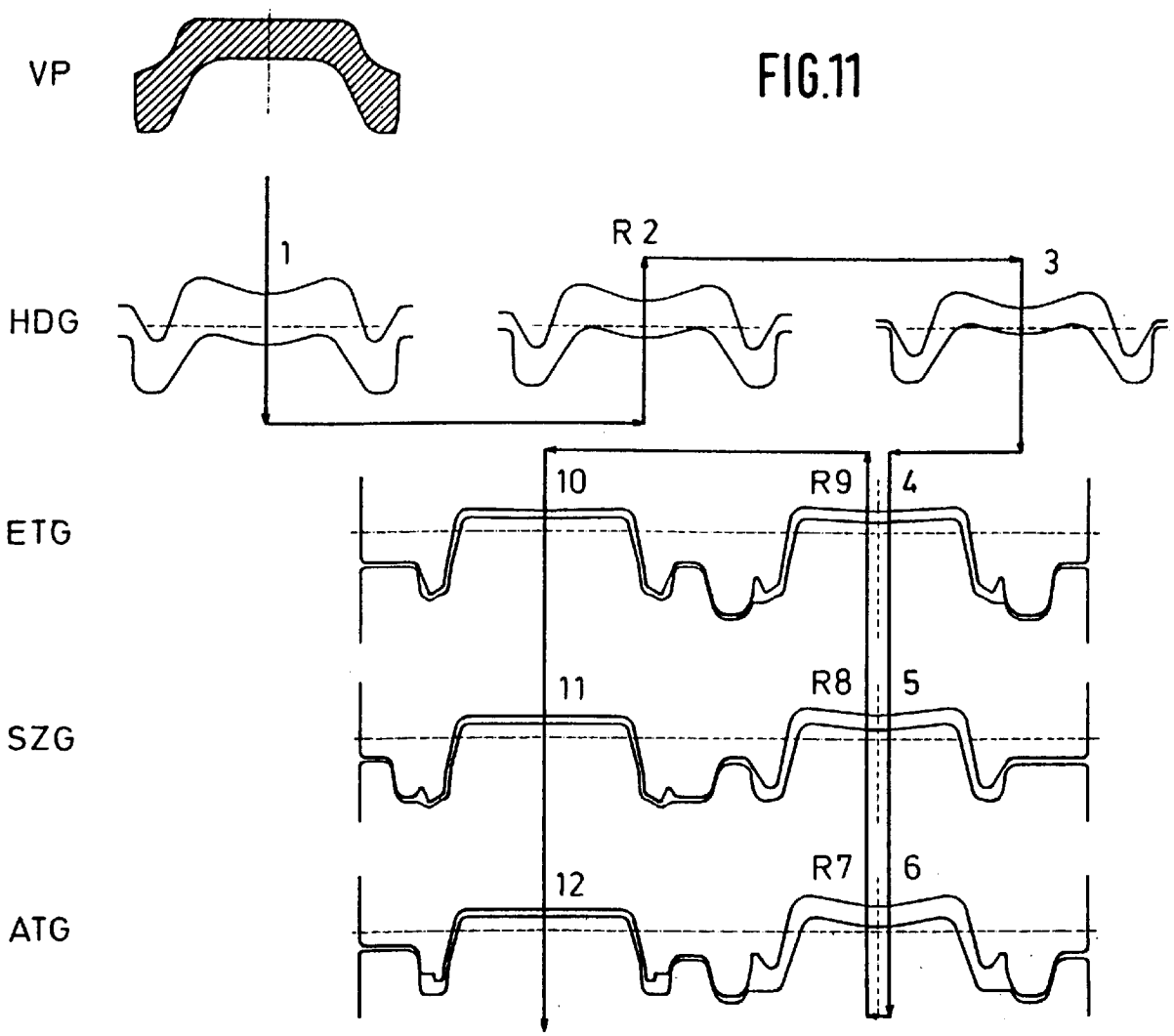

The pass schedule according to FIG. 11 differs from that of FIG. 10 in that an intermediate edging stand SZG is arranged between the two tandem stands ETG and ATG of the compact rolling group, so that the preliminary section emerging from the roughing rolling group and preshaped in three passes 1, R2 and 3, is finish-shaped in passes 4, 5, 6 through one row of grooves of the three stands, in reversing passes R7, R8 and R9 through the same row of grooves, and subsequently in the passes 10, 11, 12. Accordingly, in this roll stand arrangement, a three-stand tandem reversing train is used in which the length of the bodies of the rolls of all three stands is equal, for example, the length is 1500 mm. In other words, not only the universal stands ETG and ATG are combination stands and can also operate as two-high stands with this length of the bodies, but the intermediate edging stand can also be reassembled into a two-high stand having this length of the roll bodies. The pass sequence then takes place in the tandem group 4, 5 and 6 and is then returned into the same row of grooves, wherein the groove is slightly adjusted for pass 6 as well as for pass R7. Basically, the passes R8 and R9 only are dummy passes. During the passes 4 and 5, the grooves remain unchanged and, consequently, are too large, so that the rolled bar is driven through these grooves.

Figure 12:
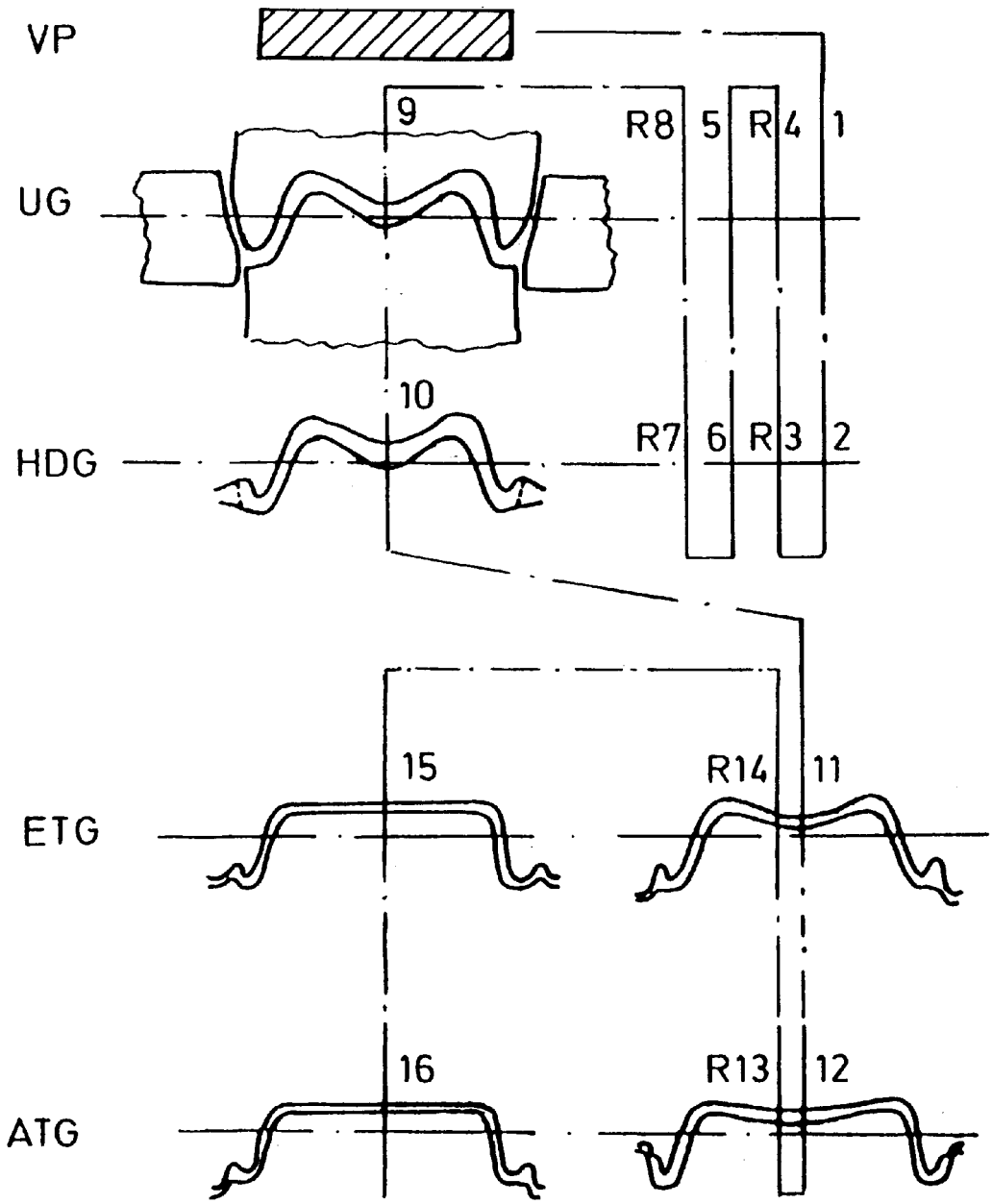

In the pass schedule according to FIG. 12, a preliminary section VP having a rectangular cross-section is preshaped in a series of passes and reversing passes 1, 2, R3, R4, 5, 6, R7, R8 and 9, 10 in the universal stand UG and the horizontal two-high stand HDG of the roughing rolling group, and the section is then finish-shaped after passes 11, 12 in the two tandem stands ETG and ATG of the compact rolling group in two successive reversing passes R13 and R14 and subsequent passes 15 and 16. Only during the return, the groove 12 is again slightly adjusted and the pass R13 essentially assumes a driving function in order to drive the bar in pass R14 through the groove 11 which has remained unchanged. It may also become necessary to slightly open the groove 11 when driving the bar through the groove R14.

Figure 13:
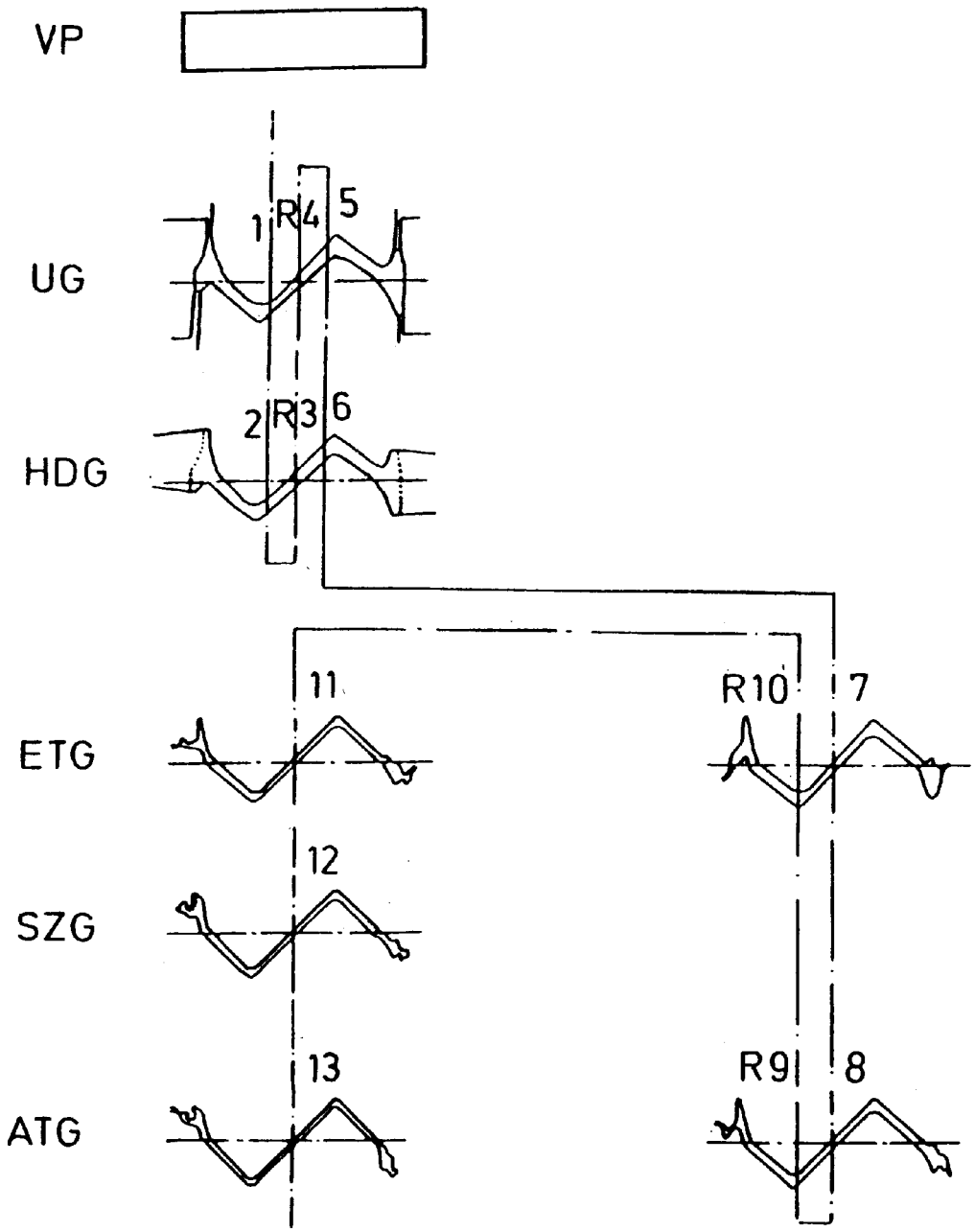

The pass schedule according to FIG. 13 corresponds to that of FIG. 12 with the difference that, after shaping the preliminary section VP with a rectangular cross-section, the section is rolled in the roughing rolling group in the universal stand UG and in the horizontal two-high stand HDG with passes 1, 2, R3, R4, 5, 6 followed by two successive passes 7 and 8 and the reversing passes R9, R10 in a subsequent pass sequence 11 through a tandem stand ETG on the entry side, a pass 12 through the intermediately arranged intermediate edging stand SZG with profiled rolls, and finish-shaping the section takes place in the following pass 13 in the tandem stand on the exit side. In this special case, the intermediate edging stand SZG has a short roll body length, i.e., the stand SZG is not a changeable stand as is the case in the universal stands which in this case again operate as two-high stands with lengths of, for example, 1500 mm, wherein the maximum length of the edging stand is 1000 mm. This means that for passes 7, 8, R9 and R10, the intermediate edging stand SZG is moved in order to shift the grooves into the rolling line and to open the grooves to such an extent that the section can easily pass through. For pass 12, the intermediate edging stand is then pushed back into the row of grooves 11, 12, 13.

Figure 14:
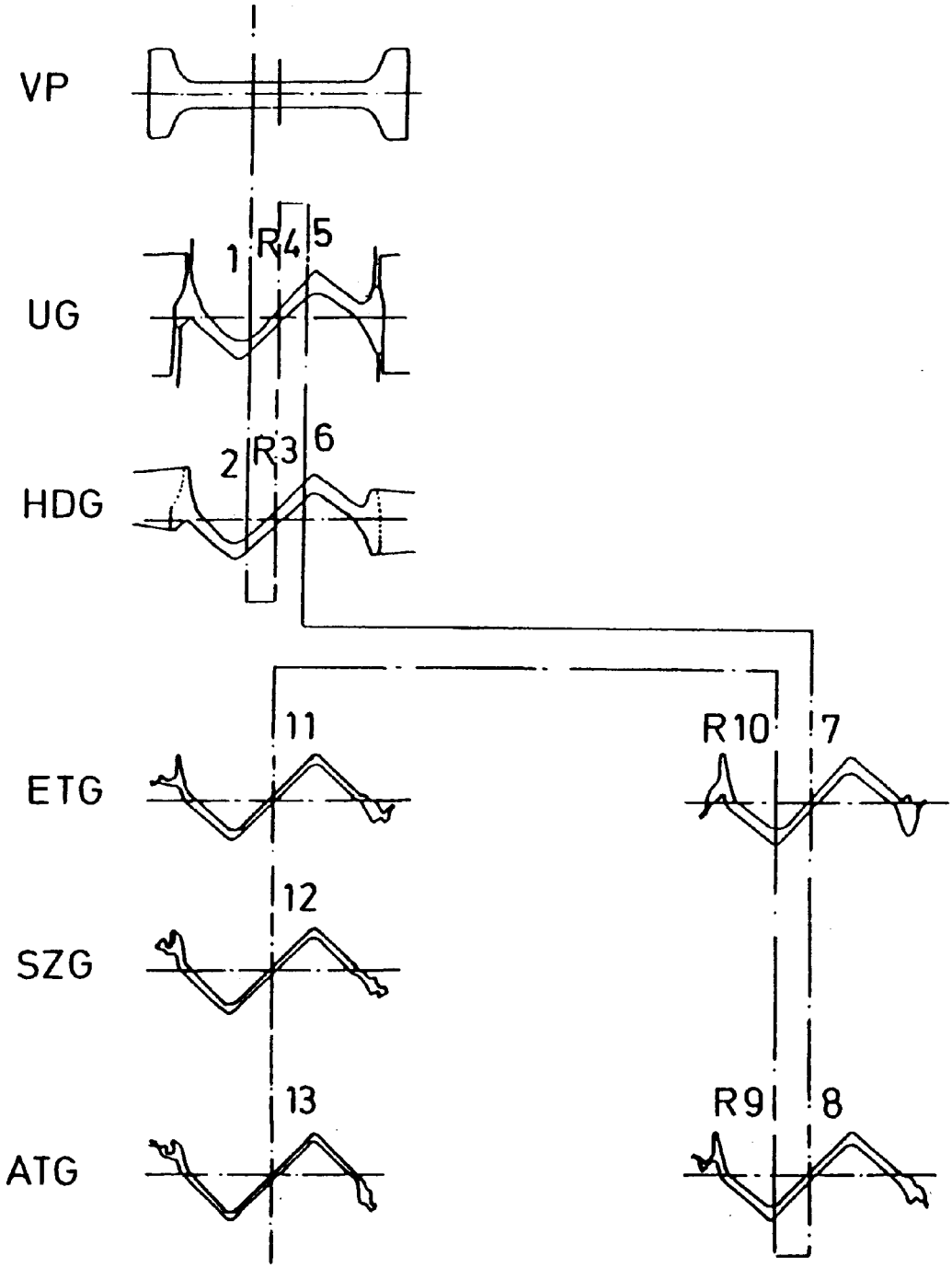

The pass schedule according to FIG. 14 corresponds to that of FIG. 13 with the exception that a preliminary section VP is used whose cross-section approximately corresponds to the cross-section of the finished section. Shaping of this preliminary section VP takes place in the universal stand UG and the horizontal two-high stand HDG of the roughing rolling group in the same pass sequence 1, 2, R3, R4, 5, 6, and the pass schedule of FIG. 13. Contrary to the pass schedule of FIG. 13, the section is directly introduced into the tandem stand ETG on the entry side and the tandem stand ATG at the exit side in the subsequent passes 7, 8, followed by passes R9 and R10 in the same grooves of these stands. Subsequently, the further shaping again corresponds with passes 11, 12, 13 to that of FIG. 13.

Figure 15:
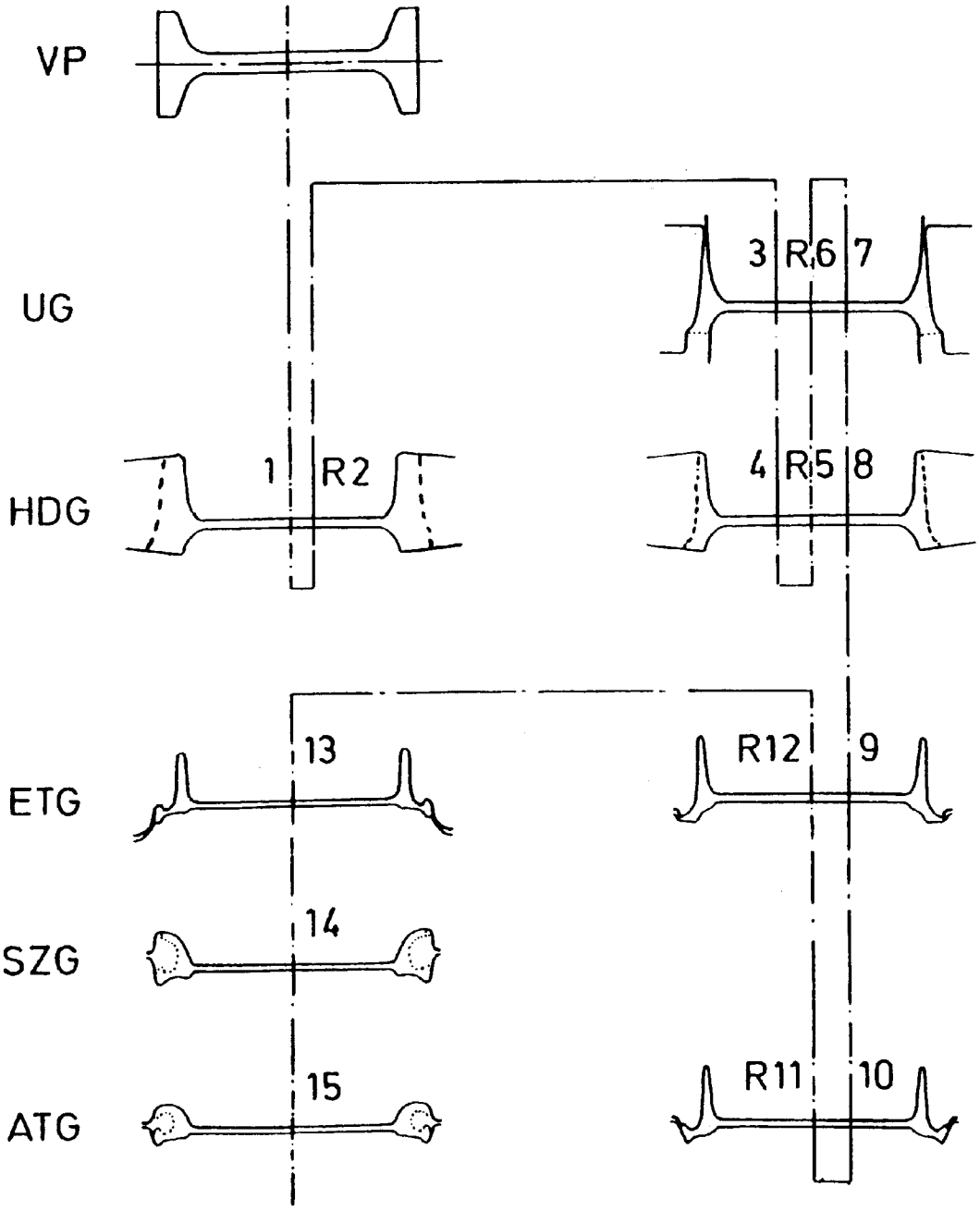

The pass schedule of FIG. 15 in principle corresponds to that of FIG. 14. The pass schedule of FIG. 15 differs with respect to the shaping of the preliminary section VP in the universal stand UG and the horizontal two-high stand HDG of the roughing rolling group in that initially a section-changing shaping takes place in the horizontal two-high stand in a pass 1 and a reversing pass R2, followed by a further shaping in subsequent passes 3, 4, the reversing passes R5, R6 and the following passes 7, 8 through the universal stand UG and the horizontal two-high stand HDG. Shaping in the compact rolling group with passes 9, 10, reversing dummy passes R11 and R12 through the row of grooves of the tandem stand ATG on the exit side and the tandem stand ETG at the entry side, and finish-shaping with the pass sequence 13, 14, 15 takes place in the other row of grooves of these stands and the intermediate edging stand SVG so as to correspond to the pass schedule of FIGS. 13 or 14.

When using an intermediate edging stand SZG in accordance with pass schedules 13, 14 and 15, the intermediate edging stand SZG must be transversely shifted for the pass sequences in the row of grooves in the tandem stands in which no shaping takes place in the intermediate upsetting stand, so that the intermediate upsetting stand does not impair passage of the rolling stock through these grooves. This is because the two rolling lines of the tandem passes are located relatively closely next to each other.

Figure 16:
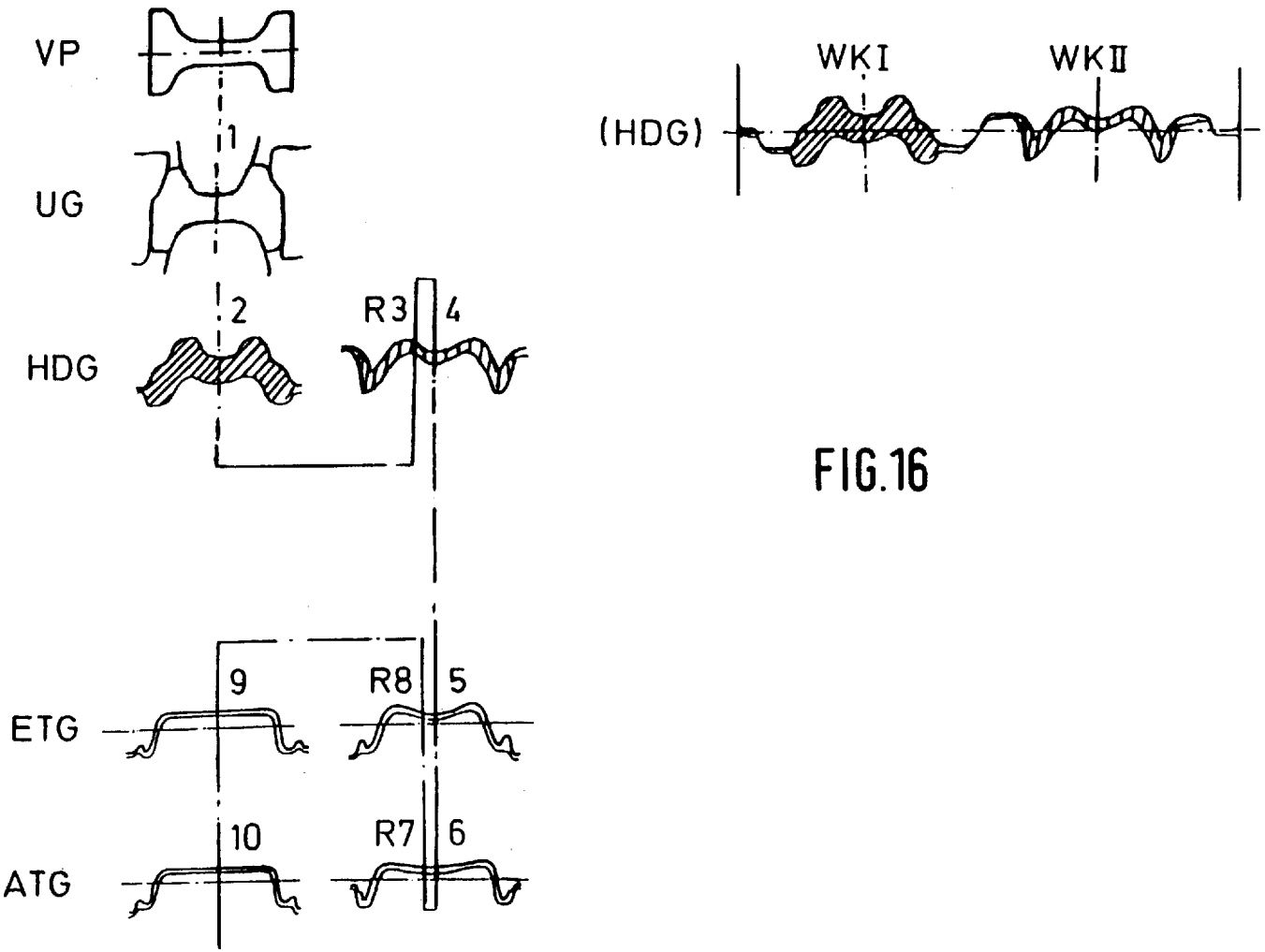
FIGS. 16–19 are pass schedules and stand arrangements corresponding to those of FIGS. 9–15, wherein the horizontal two-high stands are equipped with selectable grooves and the tandem stands on the entry side and on the exit side are not provided with intermediate edging stands.

In the pass schedule according to FIG. 16, a preliminary section VP whose cross-section approximately corresponds to the cross-section of the finished section, is shaped in a section-changing manner in the universal stand UG of the roughing rolling group in a pass 1 and is further shaped in a section-changing manner in a pass 2 in a first selectable groove WKI of the horizontal two-high stand HDG and is shaped in a section-reducing manner in subsequent passes R3 and reversing pass R4 in the selectable groove WKII. Shaping then takes place in the compact rolling group in accordance with FIG. 12 after dummy passes 5, 6 through a row of grooves of the tandem stand ETG on the entry side and the tandem stand ATG on the exit side in reversing passes R7 and R8 through this row of grooves and in subsequent passes 9, 10, through the other row of grooves until the section is finish-shaped.

Figure 17:
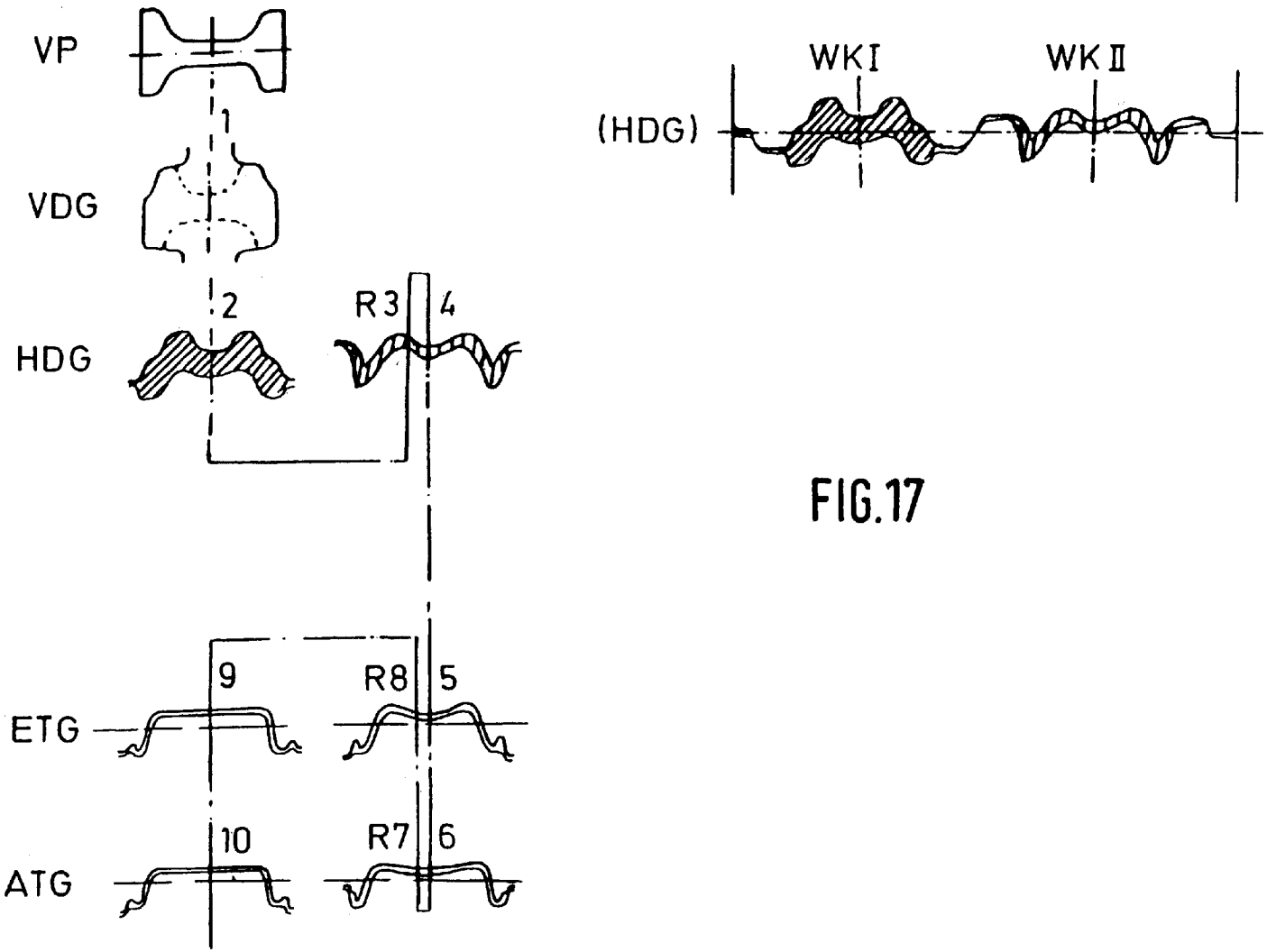

The pass schedule of FIG. 17 corresponds to that of FIG. 16 with the exception that the first pass 1 in the roughing rolling group is not carried out in a universal stand but in a vertical two-high stand with appropriately profiled rolls.

Figure 18:
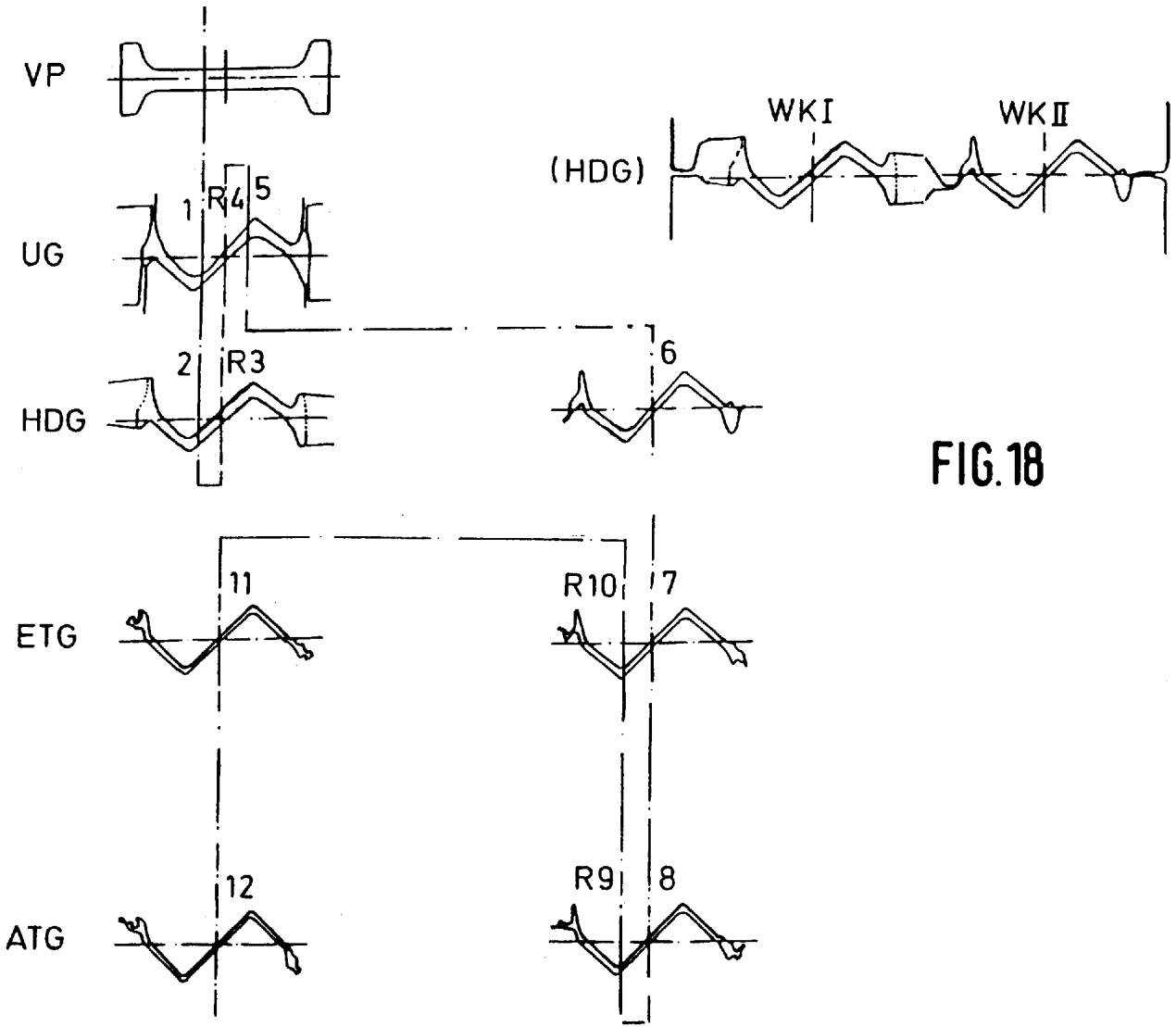

In the pass schedule according to FIG. 18, which corresponds with respect to the preliminary section VP whose cross-section approximately corresponds to the finished section and with respect to the universal stand UG with profiled rolls and the horizontal two-high roll stand HDG with two selectable grooves WKI and WKII to the configuration of the roughing rolling group of FIG. 16 and also to the compact rolling group thereof, the primary section VP is rolled in successive and reversing passes 1, 2, R3, R4, 5 between the universal stand and the selectable groove WKI of the horizontal two-high stand HDG and, after another pass 6 through the other selectable groove WKII of the horizontal two-high stand HDG with subsequent passes 7,8 and reversing dummy passes R9, R10 through one row of grooves of the two tandem stands ETG and ATG of the compact rolling group, the section is finish-shaped in passes 11 and 12 corresponding to the illustration of FIG. 16.

Figure 19:
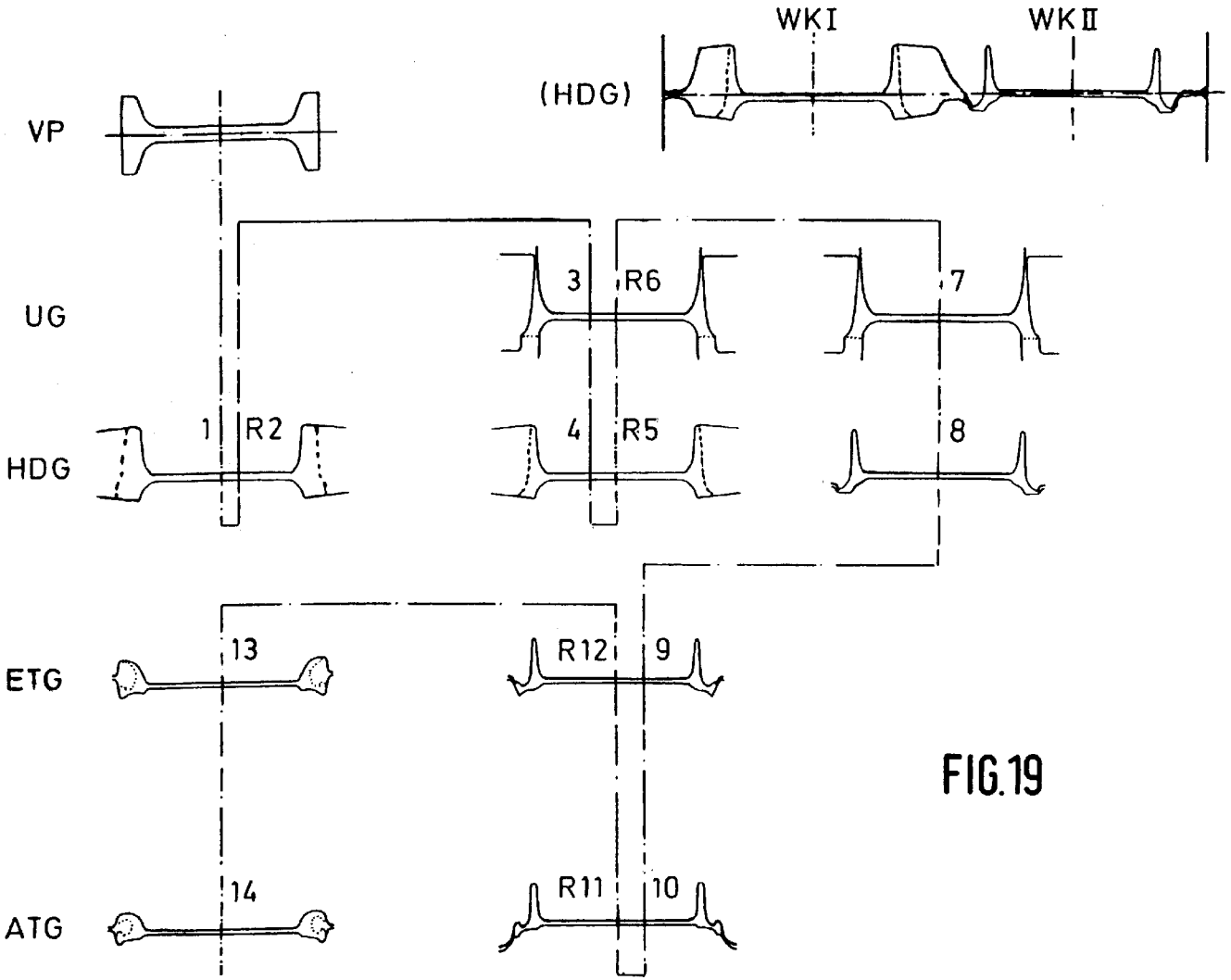

In the pass schedule according to FIG. 19, in contrast to the pass schedule of FIG. 18, the initial pass 1 in the first selectable groove WKI of the horizontal two-high stand HDG takes place in a section-changing manner. This pass is followed by a reversing pass R2 through the same groove, followed again in a reversing manner by two following passes 3 and 4 through the universal stand UG and the same selectable groove WKI, followed by two reversing passes R5 and R6 through the same grooves. With the subsequent pass 7 through the universal stand UG and pass 8 through the second selectable groove WKII of the horizontal two-high stand, the preliminary section VP has been preshaped to such an extent that it can then be introduced in the manner already described above into the first row of grooves of the tandem stand ETG on the entry side and the tandem stand ATG on the exit side of the compact rolling group and can be finish-shaped subsequently with reversing dummy passes R11, R12 through this row of grooves and subsequent passes 13, 14 through the other row of grooves, as in the configuration according to FIG. 18.

Figure 20:
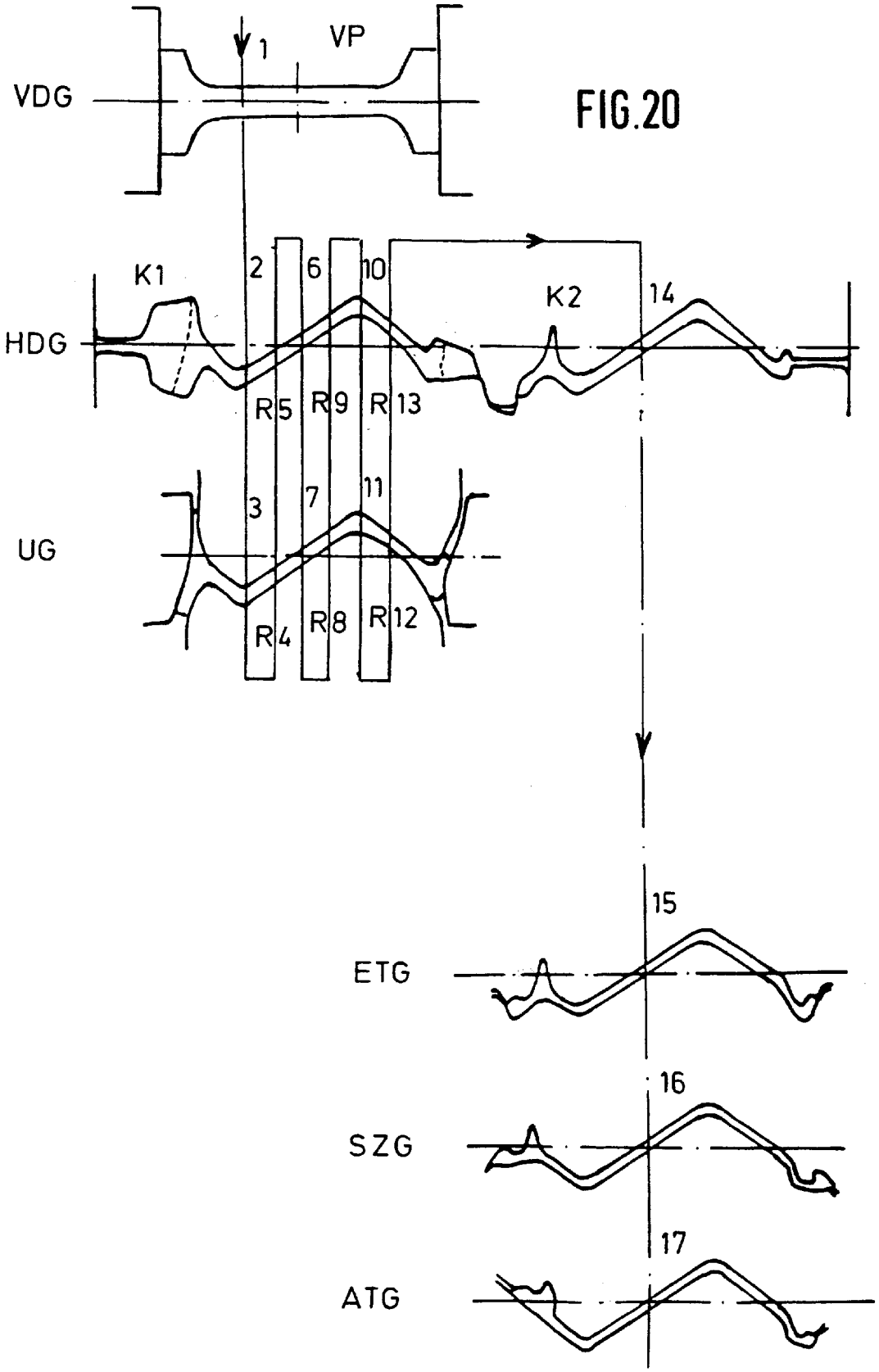
FIGS. 20 and 21 are additional pass schedules and stand arrangements in which the roughing rolling group has a vertical stand and a horizontal stand as well as a universal stand and the compact rolling group has universal stands on the entry side and on the exit side and a universal edging stand.
Figure 21:
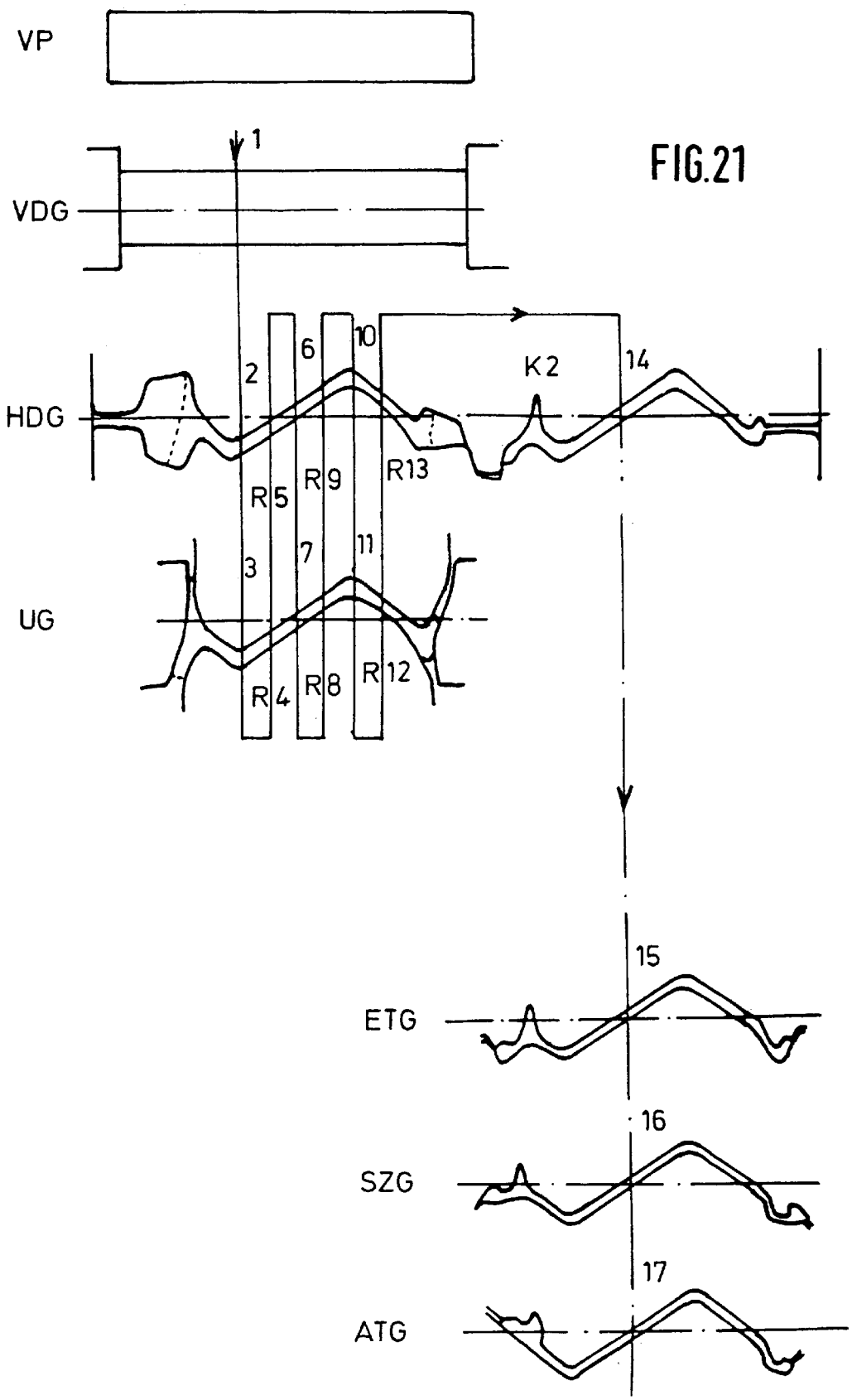

In the pass schedules for rolling Z-shaped piling sections according to FIGS. 20 and 21, the roughing rolling group has following the vertical two-high stand VDG a horizontal two-high stand HDG with two grooves K1, K2 or selectable grooves and following the stand HDG, a universal stand UG with profiled rolls. The compact rolling group is composed of a tandem stand ETG on the entry side, a tandem stand ATG on the exit side, and an intermediate edging stand arranged between the tandem stands. These stands are equipped with profiled rolls; in the two tandem stands ATG and ETG ,it is also possible to use two-high rolls.

The preliminary section VP, which may have a rectangular cross-section or a cross-section corresponding approximately to the finished section, is edged in a pass 1 in the vertical two-high stand VDG and is subsequently shaped in a section-reducing manner in a plurality of successive passes 2, 3 in the first groove K1 or the selectable groove of the horizontal two-high stand HDG and in the universal stand UG and corresponding subsequent reversing passes R4, R5 in the universal stand UG and the selectable groove WKI of the horizontal two-high stand HDG and the subsequent passes 6, 7; R8, R9; 10, 11; R12, R13, and the section is subsequently shaped in a section-changing manner in the second groove K2 or selectable groove of the horizontal two-high stand HDG in another pass 14, and is then finish-shaped with three successive passes 15, 16, 17 in the tandem stand ETG on the entry side, in the intermediate edging stand SZG and in the tandem stand ATG on the exit side.

Figure 22:
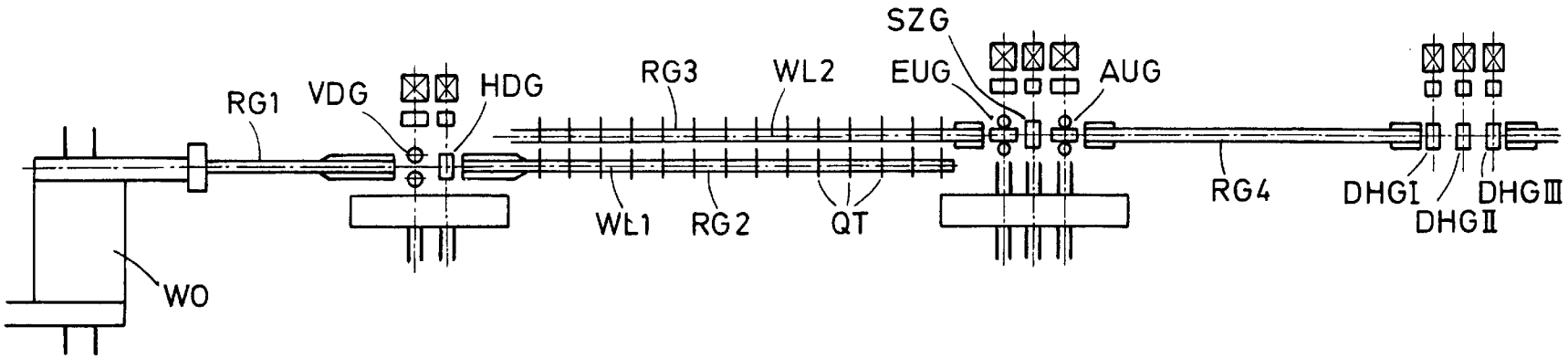
FIG. 22 is a schematic top view of a roll stand arrangement.

In this pass schedule with universal stand, horizontal edging stand, and universal finishing stand, the tandem reversing train constitutes a pure universal train and the stands can operate without reassembly. As can be seen in FIG. 22, following a heating furnace WO which also may be a reheating furnace connected directly to the continuous casting plant for heating the strand sections which are hot from the continuous casting to rolling temperature, a roller table RG1 is arranged which leads to a roughing stand group which on the entry side is composed of a vertical two-high stand VDG and on the exit side of a horizontal two-high stand HDG. In the same rolling line WL1, this group of roughing roll stands is followed by a roller table RG2. A transverse conveying unit QT leads to a parallel roller table RG3 which in a second rolling line WL2 leads to the compact tandem stand group composed of a universal stand EUG on the entry side, an intermediate edging stand SZG and a universal stand AUG on the exit side and followed by a roller table RG4 which leads in the same rolling line WL2 to the successively arranged two-high horizontal stands DHG1, DHG2 and DHG3 which are equipped with profiled rolls.

Figure 23:
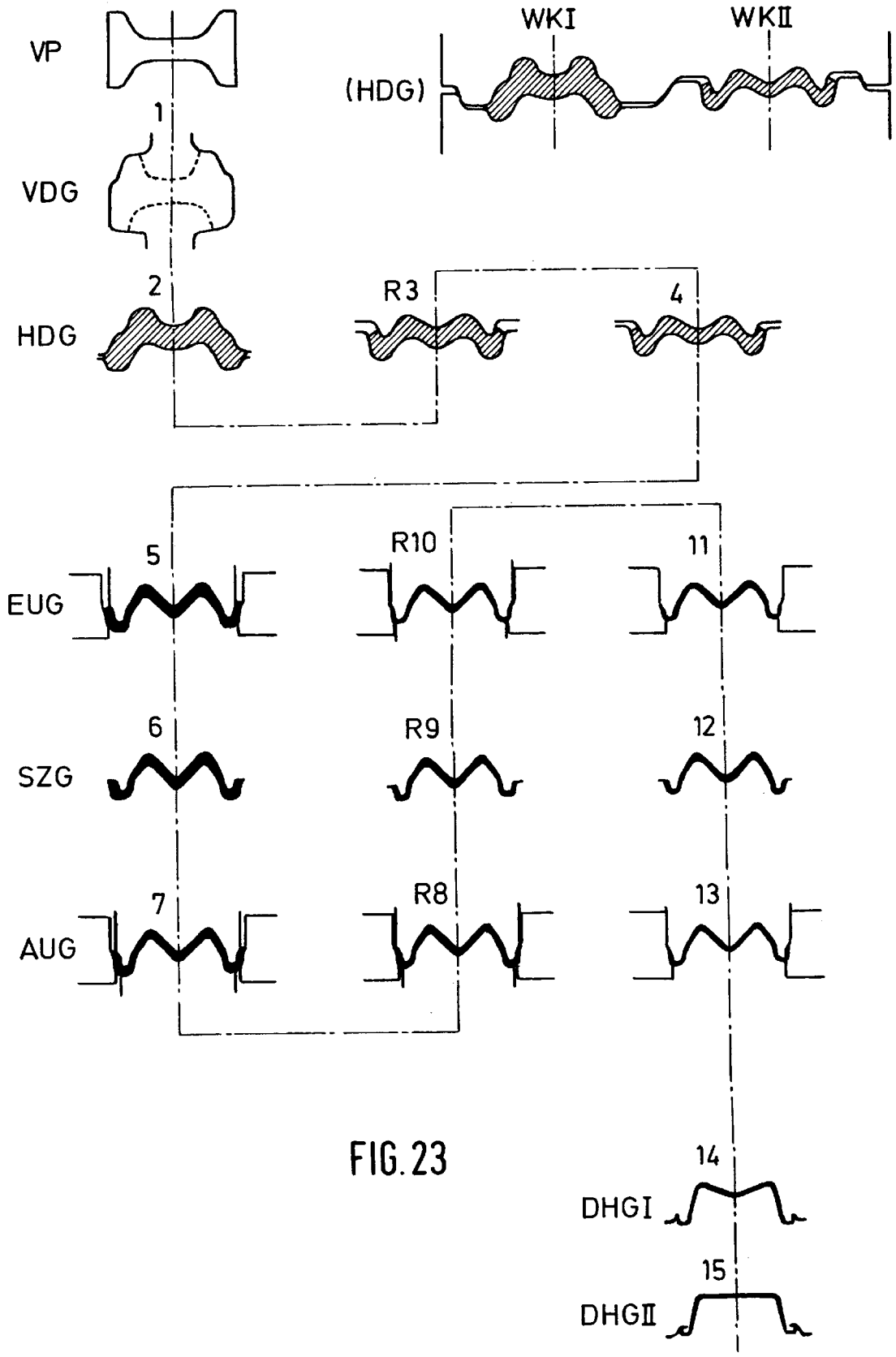
FIG. 23 is a pass schedule for the roll stand arrangement of FIG. 22.

As illustrated in FIG. 23, the preliminary section VP is edged in a first pass 1 in the vertical two-high stand VDG and is shaped in a subsequent pass 2 in the selectable groove WKI of the horizontal two-high stand HDG and is then reduced in a reversing pass R3 and a subsequent pass 4 in the selectable groove WKII. This is then followed by a continuous sequence of three passes 5, 6 and 7 through the universal stand EUG on the entry side, the intermediate edging stand SZG and the universal stand AUG on the exit side of the compact tandem stand group, followed by the reversing passes R8, R9 and R10 in the reverse direction and reverse sequence of the stands, and followed by renewed passage with the subsequent passes 11, 12 and 13 through the same row of stands. The finished basic shape of the sheet piling section achieved in a reducing operation in these tandem pass sequences is finish-shaped in immediately following successive passes 14 and 15 in the grooves of the two-high horizontal stands DHGI and DHGII so as to finally shape the interlock ends.

Figure 24:
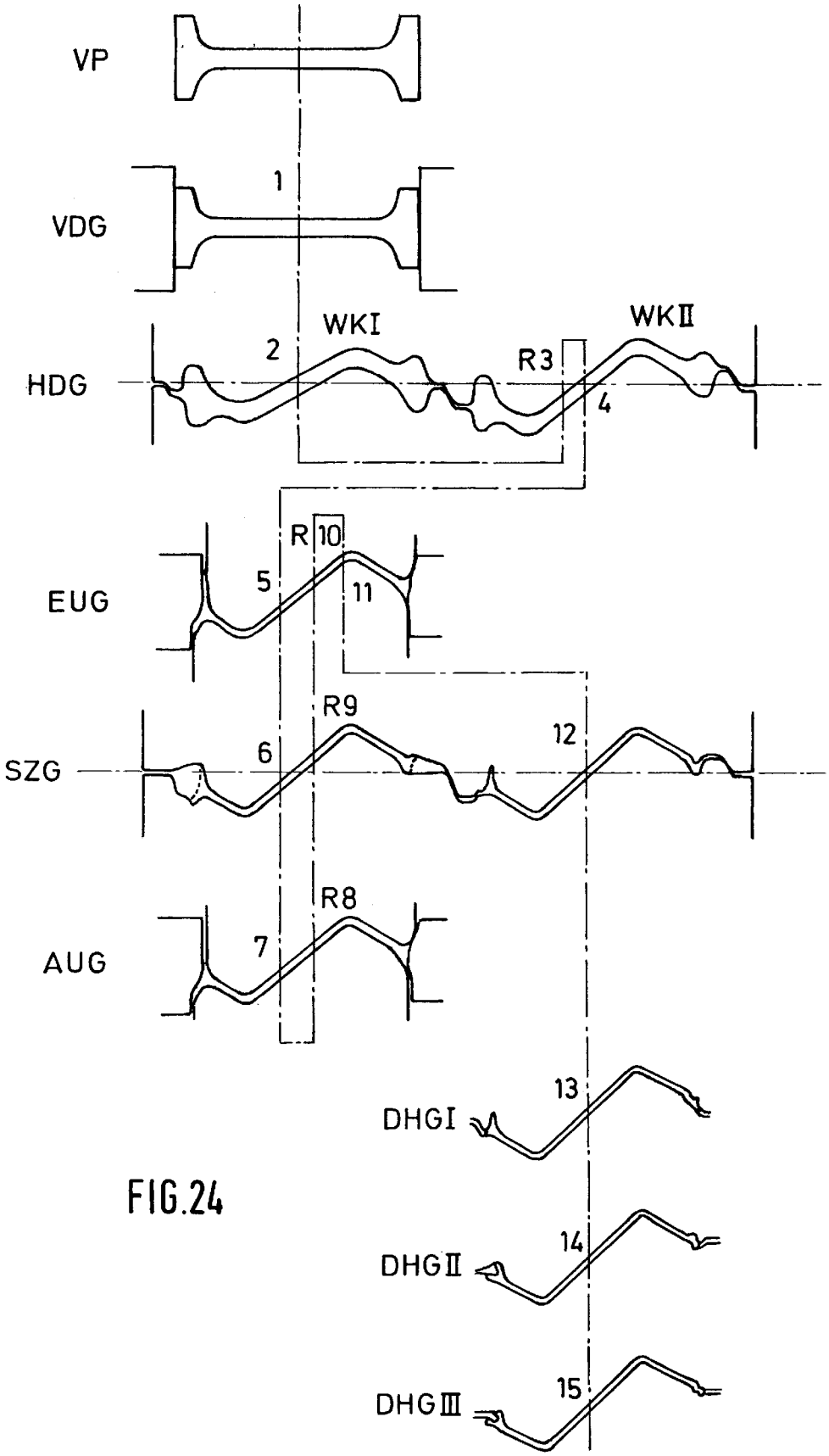
FIG. 24 is another pass schedule for the roll stand arrangement of FIG. 22.

In the pass schedule according to FIG. 24, the preliminary section VP is also edged in a first pass 1 in the vertical two-high stand VDG and is subsequently preshaped in a subsequent pass 2 through the horizontal two-high stand HDG of the roughing rolling group in the selectable groove WKI thereof. This shape is reduced in a reversing pass R3 and another pass R4 through the selectable groove WKI thereof. This shape is reduced in reversing pass R3 and another pass 4 through the selectable groove WKII and is further reduced in a pass sequence 5, 6 and 7 through the universal stand EUG on the entry side, the intermediate edging stand SZG and the universal stand AUG on the exit of the compact tandem stand group and a subsequent reversing pass sequence R8, R9 and R10 and a following pass 11 through the universal stand EUG on the entry side and is finally preshaped in a pass 12 through the second selectable groove of the intermediate edging stand SZG. The interlock ends of the sheet piling section finish-rolled in its basic shape in this manner are finish-rolled immediately subsequently in a continuous pass sequence 13, 14, 15 in the two-high horizontal stands DHGI, DHGII and DHGIII.

Figure 25:
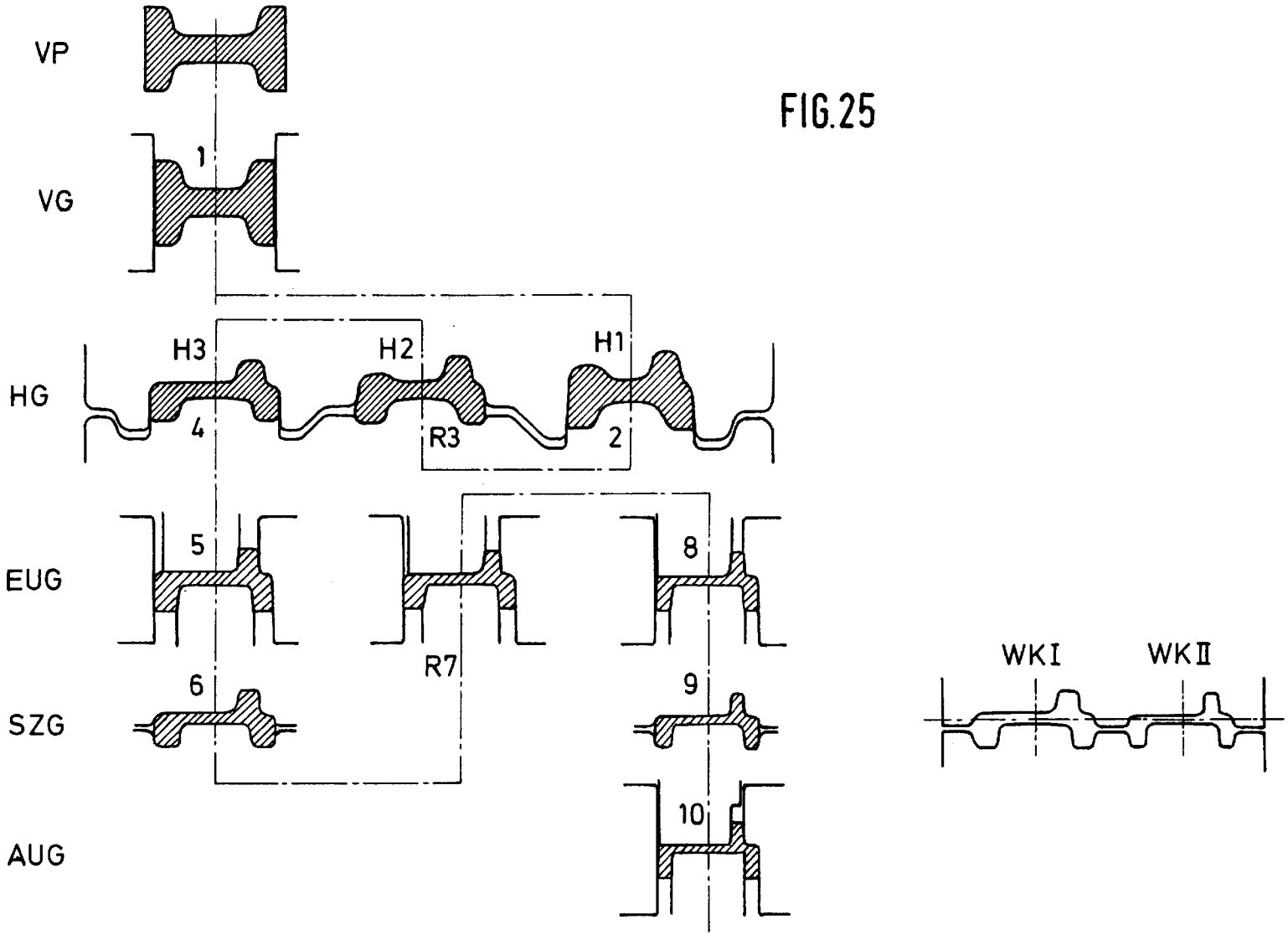
FIG. 25 is a pass schedule for another roll stand arrangement.

As shown in FIG. 25, the preliminary section BP is edged in the vertical stand BG of the roughing rolling group in a pass 1 and is subsequently shaped and reduced in a sequence of three passes or reversing passes 2, R3 and 4 through three selectable grooves H1, H2 and H3 of the horizontal stand HG of the roughing rolling group and is then further reduced in two successive passes 5 and 6 in the universal stand EUG on the entry side and in the first selectable groove WKI of the intermediate edging stand SZG, subsequently in a reversing stand R7 and a subsequent pass 8 through the universal stand AUG on the entry side and a subsequent pass 9 through the second selectable groove WKII of the intermediate edging stand SZG, and is finish-shaped in a subsequent pass 10 through the universal stand AUG on the exit side.

As shown in the pass schedule according to FIG. 26, the preliminary section VP is edged in a pass 1 through the vertical stand VG of the roughing rolling group and is subsequently shaped with respect to its sectional shape in a subsequent pass 2 through the groove of the horizontal stand HG. This is followed by three successive passes 3, 4, and 5 through the first shaping groove K1 of the tandem stand ETG on the entry side, the intermediate edging stand SZG and the tandem stand ATG on the exit side and subsequently in the reverse sequence in three reversing passes R6, R7, R8 through the same stands producing a further shape reduction. These pass sequences are followed by three additional subsequent passes 9, 10, 11 through the row of second groove K2 of these stands, with the finish-shaped crawler chain section emerging from the groove of the tandem stand ATG on the exit side.

Figure 26:
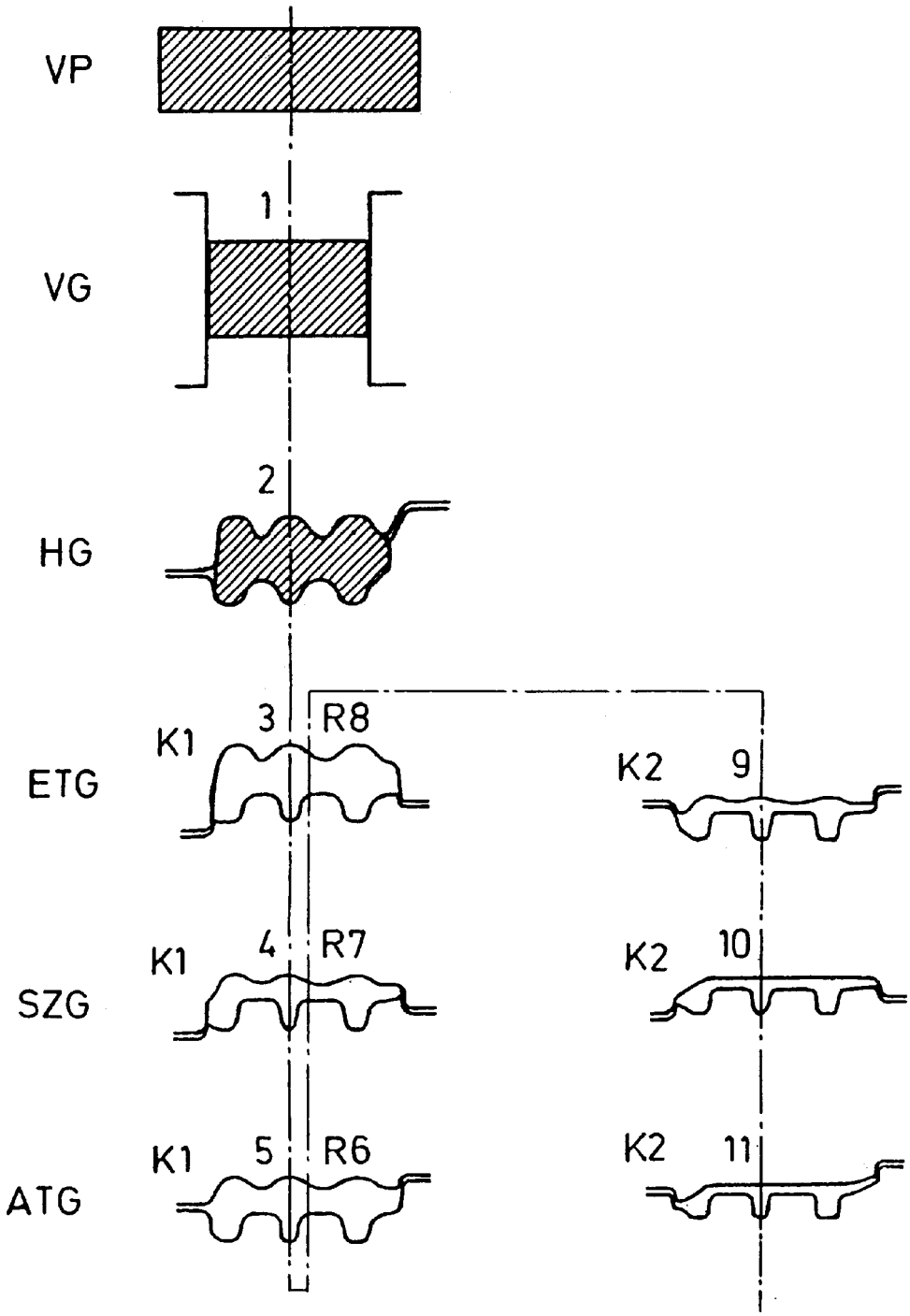
FIGS. 26 and 27 are pass schedules for rolling a preliminary section having a rectangular cross-section.
Figure 27:
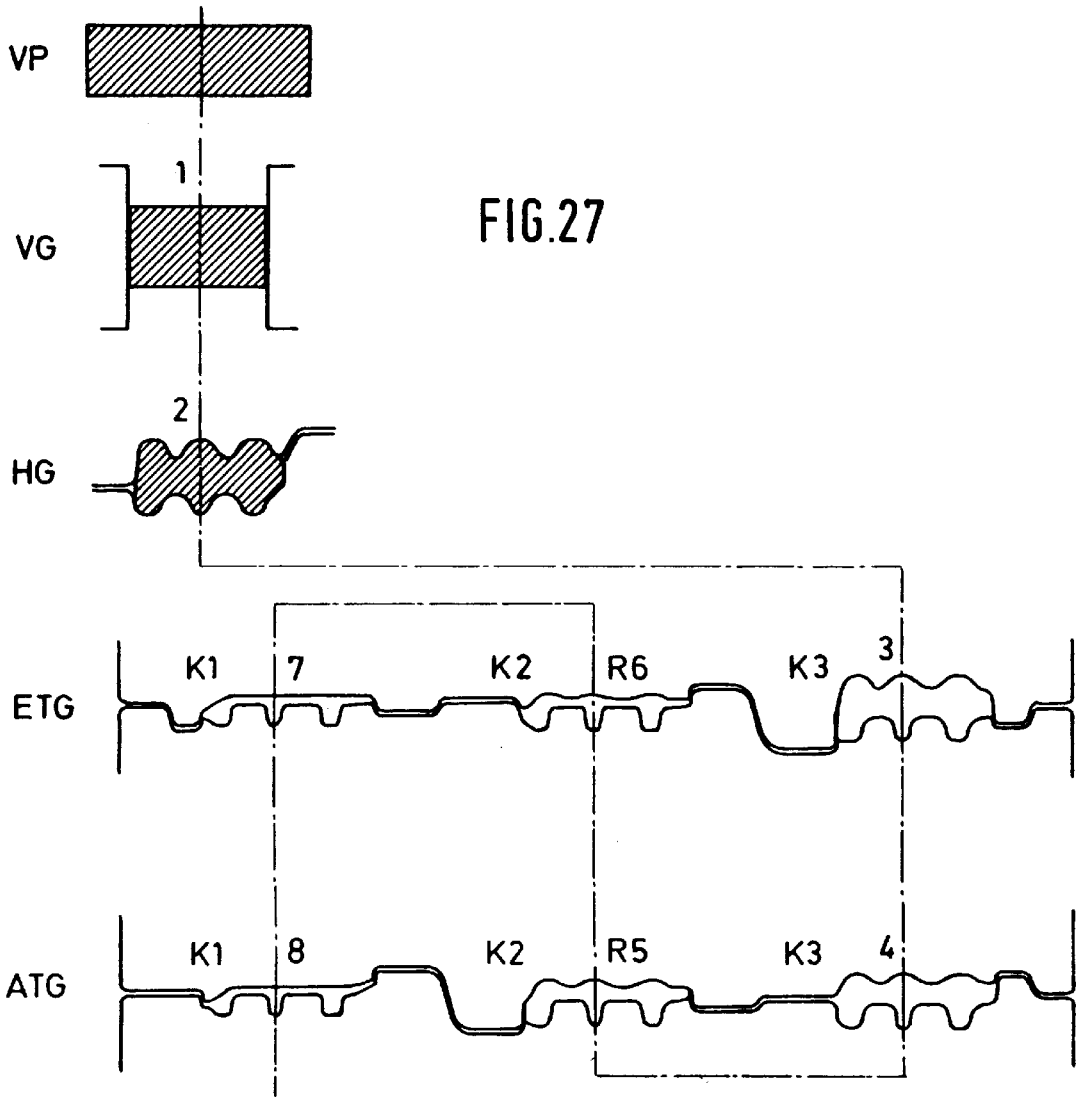

In the pass schedule according to FIG. 27, the passes 1 and 2 of the roughing rolling group correspond to those of the pass schedule of FIG. 26. The section emerging after pass 2 from the shaped groove of horizontal stand HG is then shaped in a section-reducing manner in two successive passes 3 and 4 through the row of grooves K3 of the tandem stands ETG and ATG on the input side and the output side, respectively, and this section is guided and further reduced in two reversing passes R5 and R6 in the reverse direction through the row of grooves K2 of the two stands. These passes are followed by two additional successive passes 7 and 8 through the row of grooves K1 in the opposite direction, wherein the pass 8 through the tandem stand ATG on the exit side is the finishing pass.

Figure 28:
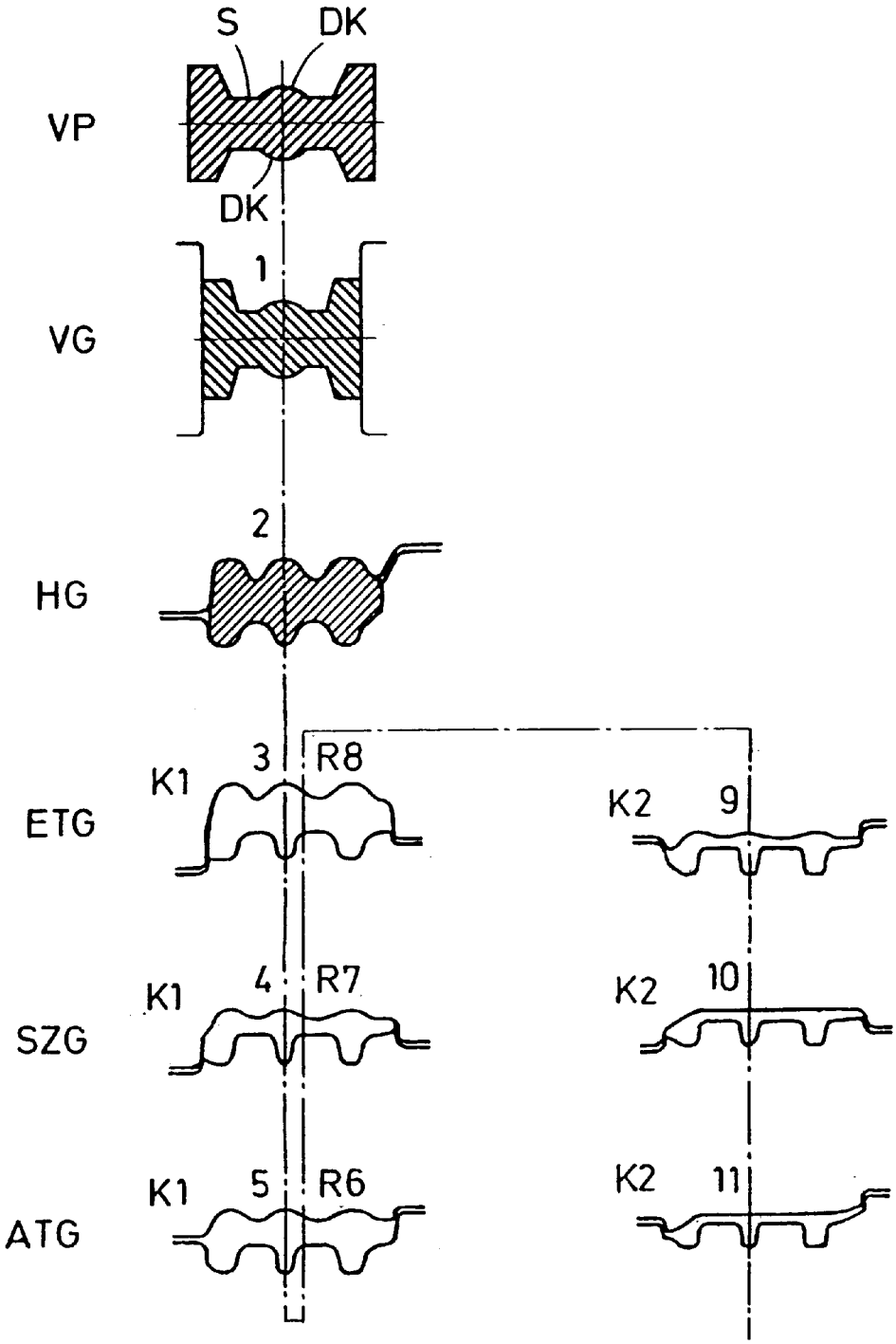
FIGS. 28 and 29 are additional pass schedules for rolling a preliminary section having an I-shaped cross-section.
Figure 29:
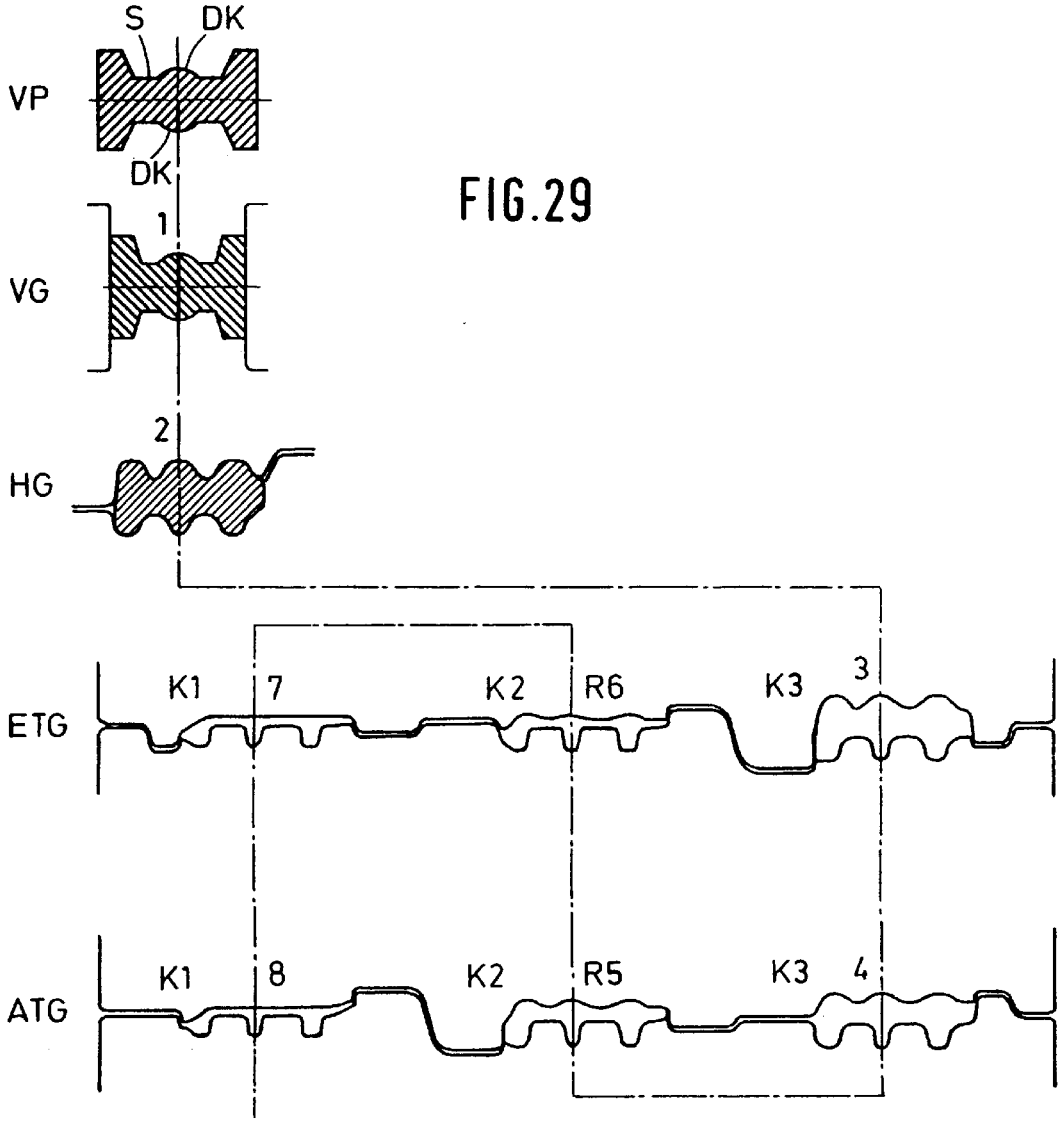

The pass schedules according to FIGS. 28 and 29 correspond to the above-described pass schedules of FIGS. 26 and 27 with the exception that a preliminary section is used with I-shaped cross-section, wherein the web S is provided on both sides with an increased thickness portion DK.

Figure 30:
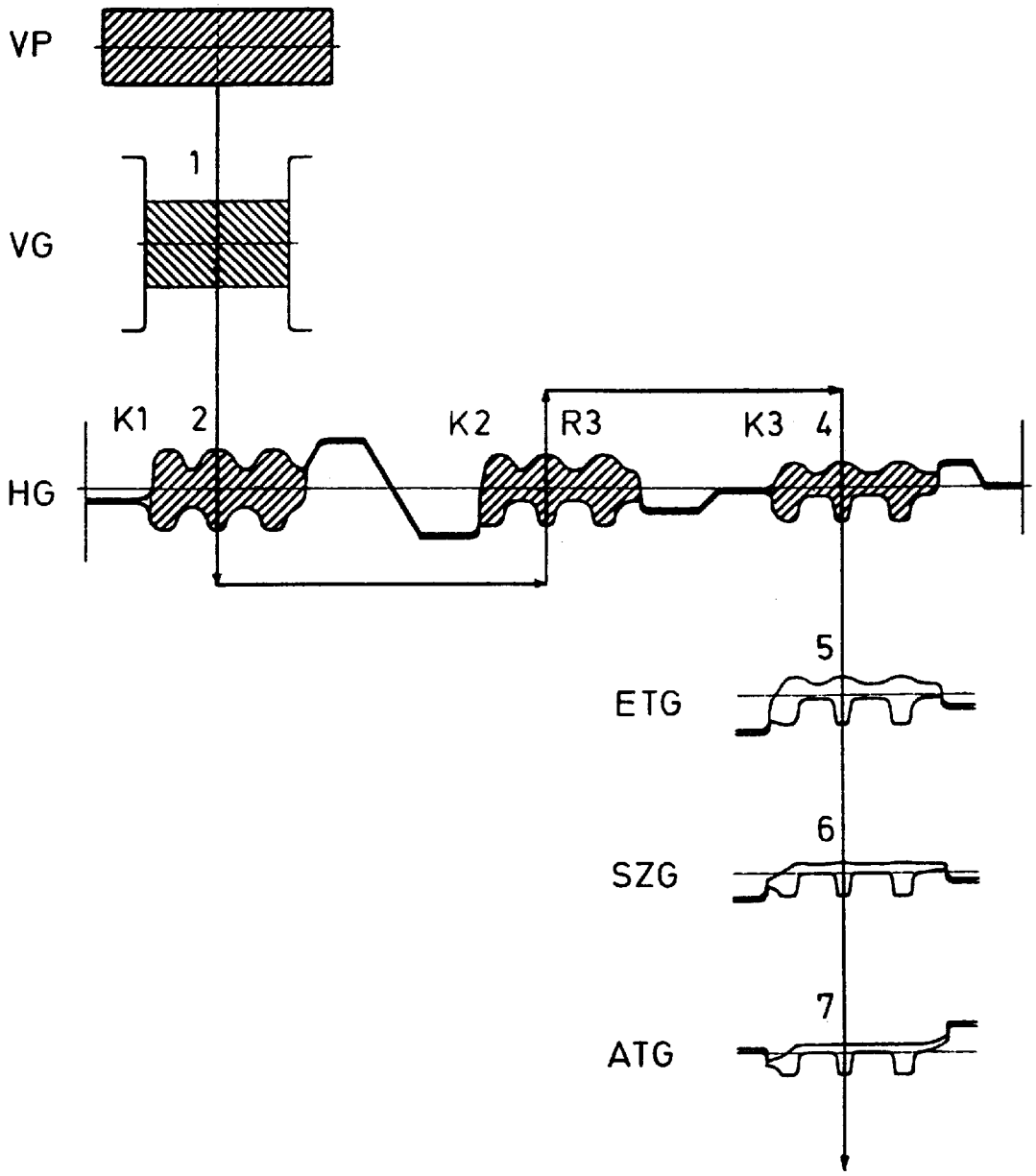
FIGS. 30 and 31 are other pass schedules for rolling a preliminary section having a rectangular cross section and a preliminary section having an I-shaped cross-section.
Figure 31:
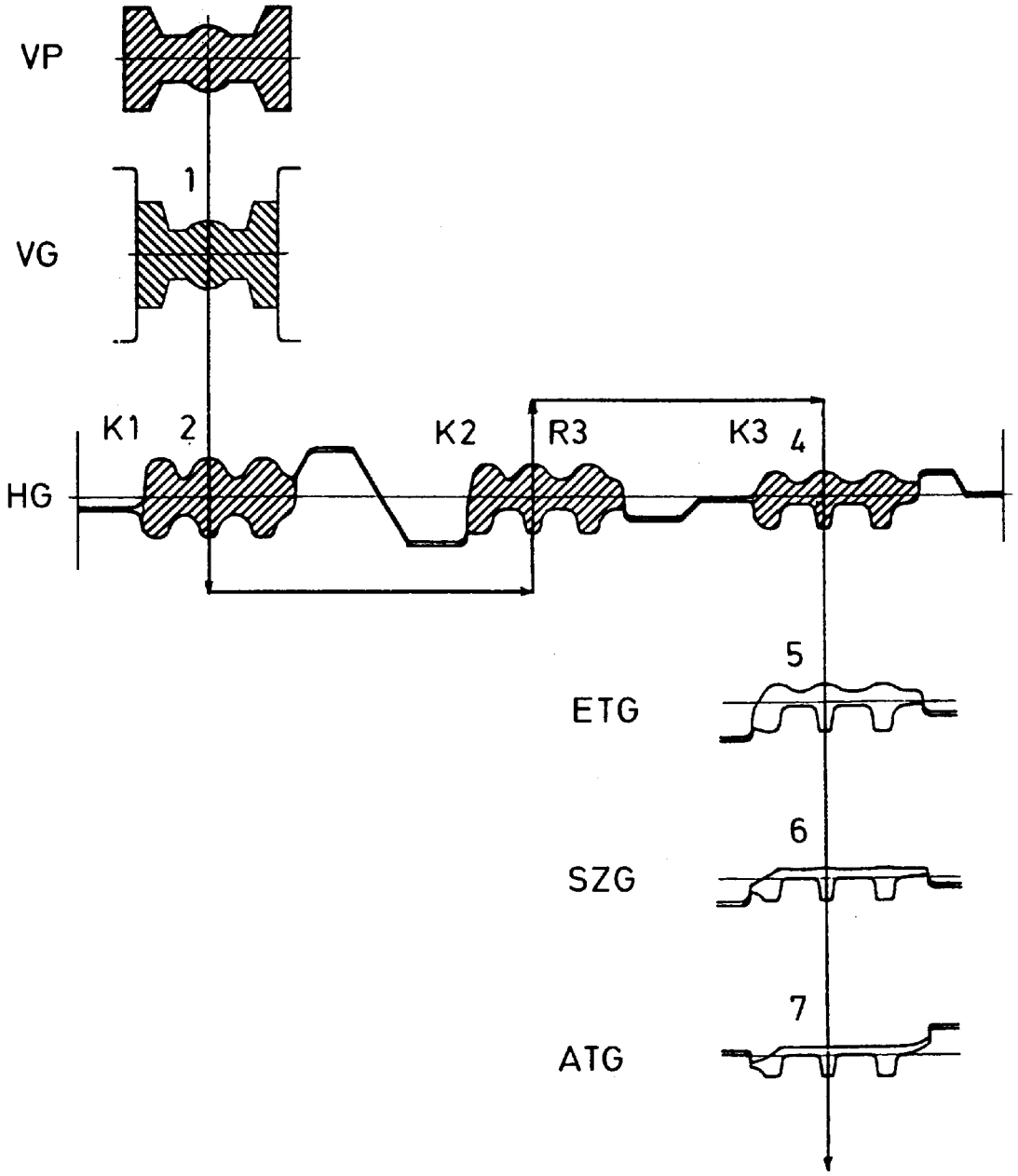

In the pass schedules according to FIGS. 30 and 31, the preliminary section, as is the case in the above-explained pass schedules of FIGS. 26–29, is edged in a first pass 1 in the vertical stand VG of the roughing rolling group, but is then shaped in a section-reducing manner in a sequence of passes and reversing passes 2, R3 and 4 in the horizontal stand HG of the roughing rolling group, which in this case is equipped with three selectable grooves K1, K2 and K3, and is then finish-shaped in a single sequence of three passes 5, 6, 7, in the grooves of the stands of the compact tandem group, i.e., the tandem stand ETG on the entry side, the intermediate edging stand SZG and the tandem stand ATG on the exit side.

While specific embodiments of the invention have been shown and described in detail to illustrate the inventive principles, it will be understood that the invention may be embodied otherwise without departing from such principles.

We claim:

1. A method of rolling finished sections from a preliminary section using roll stand arrangements which operate in a reversing operation, the roll stand arrangements including a compact rolling group composed of a first universal stand at an entry side and a second universal stand at an exit side and an intermediate edging stand arranged between the universal stands, and a roughing rolling group arranged in front of the compact rolling group and composed of vertical roll stands and horizontal rolls stands and/or universal stands, the method comprising, with one or more of the roll stands of the roughing rolling group and/or one or more of the roll stands of the compact rolling group being equipped with several selectable grooves which can optionally be moved into and out of a rolling line, or with grooves of a roll stand located next to each other which can become effective for rolling by displacing the rolling stock transversely of the rolling line, preshaping a rectangular preliminary section or a preliminary section having approximate final dimensions in the roll stands of the roughing rolling group in a number of shape changing passes or shape reduction passes, possibly in a reversing manner with or without the use of selectable grooves, subsequently further shaping the section in the compact rolling group, possibly in a reversing manner in several shape changing passes or shape reduction passes in the universal stand on the entry side, possibly in the intermediate edging stand with or without the use of the selectable grooves or grooves of the roll stands located next to each other, and subsequently shaping the section into the finished section in the universal stand on the exit side or in the intermediate edging stand, wherein the roughing rolling group includes a vertical two-high stand or a universal stand and a horizontal two-high stand and the compact rolling group includes a tandem stand each on the entry side and on the exit side, each having two-high roll sets with two or more grooves and with corresponding transverse shifting devices for the rolling stock and an intermediate edging stand with or without selectable grooves arranged between the two tandem stands, comprising shaping in a section-changing manner a preshaped preliminary section or a preliminary section having a rectangular cross-section in the universal stand possibly equipped with profiled horizontal rolls and in the horizontal two-high stand of the roughing rolling group also possibly provided with profiled horizontal rolls in several reversing passes between the two roll stands, and subsequently finish-shaping the section in a reversing manner in the grooves of the two tandem stands with or without carrying out a pass in the intermediate edging stand having profiled rolls.

2. The method according to claim 1, wherein the horizontal two-high stand of the roughing rolling group is equipped with profiled rolls, comprising edging the preliminary section in the vertical two-high stand in one or more reversing passes, subsequently shaping in a section-changing and section-reducing manner in one pass in the horizontal two-high stand and subsequently in reversing pass sequences in the tandem stands.

3. The method according to claim 1, wherein the horizontal two-high stand is equipped with profiled rolls, comprising shaping in a section-reducing manner a preliminary section having a cross-section approximately corresponding to the cross-section of the finished section in several reversing passes in the horizontal two-high stand and subsequently shaping in an essentially further section-reducing manner in the tandem stands with or without intermediate arrangement of an intermediate edging stand also having profiled rolls.

4. The method according to claim 1, wherein the universal stand and the horizontal two-high stand of the roughing rolling group are equipped with selectable grooves or profiled rolls, comprising carrying out shaping of the preliminary section in several reversing passes successively in both roll stands and further in a reversing operation in the two tandem stands with or without the intermediate arrangement of an intermediate edging stand having profiled rolls.

5. The method according to claim 4, comprising shaping the section in a section-changing or in a section-reducing manner initially in one pass and a reversing pass in the horizontal two-high stand, subsequently, in several reversing passes successively in the universal stand and the horizonal two-high stand and then conveying the section to the two tandem stands and the intermediate upsetting stand of the compact rolling group.

6. The method according to claim 1, wherein a universal stand is used or the vertical two-high stand in the roughing rolling group is equipped with profiled rolls and the horizontal two-high stand is equipped with selectable grooves, comprising shaping the preliminary section having a cross-section approximately corresponding to the finished section in section-changing and section-reducing manner in the universal stand or in the vertical two-high stand in one pass and subsequently in two or more reversing passes in the two selectable grooves of the horizontal two-high stand, and subsequently finish-shaping the section in reversing passes in the tandem stands of the compact rolling group.

7. The method according to claim 1, wherein the roughing rolling group includes a universal stand and a horizontal two-high stand with selectable grooves, comprising shaping in a shape-changing and shape-reducing manner the preliminary section in successive and reversing passes in the universal stand and in the first selectable groove of the horizontal two-high stand, subsequently, after a last reversing pass, shaping through the universal stand and a subsequent pass through the second selectable groove of the horizontal two-high stand, and finish-shaping the section in subsequent passes and reversing passes in the tandem stands of the compact rolling group.

8. The method according to claim 1, wherein the roughing rolling group includes a universal stand and a horizontal two-high stand with selectable grooves, comprising shaping in a shape-changing and shape-reducing manner the preliminary section in two reversing passes in the first selectable groove of the horizontal two-high stand, then again in the universal stand and subsequently in the same selectable groove of the horizontal two-high stand and again reversing through the first selectable groove and the universal stand, and then in successive passes through the universal stand and the second selectable groove of the horizontal two-high stand, and finish-shaping the section in subsequent passes and reversing passes in the tandem stands.

9. A method of rolling finished sections from a preliminary section using roll stand arrangements which operate in a reversing operation, the roll stand arrangements including a compact rolling group composed of a first universal stand at an entry side and a second universal stand at an exit side and an intermediate edging stand arranged between the universal stands, and a roughing rolling group arranged in front of the compact rolling group and composed of vertical roll stands and horizontal rolls stands and/or universal stands, the method comprising, with one or more of the roll stands of the roughing rolling group and/or one or more of the roll stands of the compact rolling group being equipped with several selectable grooves which can optionally be moved into and out of a rolling line, or with grooves of a roll stand located next to each other which can become effective for rolling by displacing the rolling stock transversely of the rolling line, preshaping a rectangular preliminary section or a preliminary section having approximate final dimensions in the roll stands of the roughing rolling group in a number of shape changing passes or shape reduction passes, possibly in a reversing manner with or without the use of selectable grooves, subsequently further shaping the section in the compact rolling group, possibly in a reversing manner in several shape changing passes or shape reduction passes in the universal stand on the entry side, possibly in the intermediate edging stand with or without the use of the selectable grooves or grooves of the roll stands located next to each other, and subsequently shaping the section into the finished section in the universal stand on the exit side or in the intermediate edging stand, wherein the roughing rolling group includes a vertical two-high stand, a horizontal two-high stand and a universal stand, and the compact rolling group includes a tandem stand on the entry side, an intermediate edging stand and a tandem stand on the exit side, and wherein the horizontal two-high stand is equipped with two grooves or selectable grooves and the universal stand is equipped with grooved rolls, comprising edging a preliminary section having a rectangular cross-section or a cross-section approximately corresponding to the finished section in the vertical two-high stand, shaping the section in a section-changing manner in a plurality of successive passes in the first groove or the selectable groove of the horizontal two-high stand and in the universal stand and in corresponding reversing passes in the universal stand and in the horizontal two-high stand and subsequently in the second groove or selectable groove of the horizontal two-high stand in another pass, and then finish-shaping the section in three successive passes in the tandem stand on the entry side, in the intermediate edging stand and in the tandem stand on the exit side.

* * * * *